US007559625B2

(12) United States Patent
Furukawa et al.

(10) Patent No.: US 7,559,625 B2
(45) Date of Patent: Jul. 14, 2009

(54) INK JET HEAD AND INK JET RECORDING APPARATUS

(75) Inventors: Koji Furukawa, Shizuoka (JP); Yusuke Nakazawa, Shizuoka (JP)

(73) Assignee: FUJIFILM Corporation, Tokyo (JP)

( * ) Notice: Subject to any disclaimer, the term of this patent is extended or adjusted under 35 U.S.C. 154(b) by 349 days.

(21) Appl. No.: 11/386,816

(22) Filed: Mar. 23, 2006

(65) Prior Publication Data

US 2006/0214989 A1 Sep. 28, 2006

(30) Foreign Application Priority Data

Mar. 23, 2005 (JP) ..... 2005-084121

(51) Int. Cl.
*B41J 2/14* (2006.01)
*B41J 2/06* (2006.01)

(52) U.S. Cl. ..... 347/47; 347/55

(58) Field of Classification Search ..... 347/20, 347/44, 47, 55
See application file for complete search history.

(56) References Cited

U.S. PATENT DOCUMENTS 6,158,844 A 12/2000 Murakami et al.
6,817,692 B2 * 11/2004 Nakazawa et al. ..... 347/12
6,908,177 B2 * 6/2005 Suganuma ..... 347/55
2003/0146757 A1 8/2003 Aguero et al.

FOREIGN PATENT DOCUMENTS

EP 0 899 105 A2 3/1999
EP 1 442 886 A1 8/2004
JP 10-138493 A 5/1998

OTHER PUBLICATIONS

European Search Report dated Apr. 1, 2008.

* cited by examiner

*Primary Examiner*—An H Do
(74) *Attorney, Agent, or Firm*—Sughrue Mion, PLLC

(57) ABSTRACT

The ink jet head ejects ink droplets onto a recording medium and includes an ejection port substrate having ejection ports for ejecting the ink droplets and a control device that controls ejection of the ink droplets from the ejection ports. Each of the ejection ports has an outer opening formed on a side facing the recording medium and an inner opening formed on a side opposite to the side facing the recording medium. At least the inner opening has a shape anisotropy. A first opening area of the outer opening is larger than a second opening area of the inner opening. The ink jet recording apparatus includes the above ink jet head and a supporting device that supports the recording medium and the ink jet head is used to record an image corresponding to image data on the recording medium supported by the supporting device.

19 Claims, 8 Drawing Sheets

INK JET HEAD AND INK JET RECORDING APPARATUS

The entire contents of literatures cited in this specification are incorporated herein by reference.

BACKGROUND OF THE INVENTION

The present invention belongs to the field of ink jet recording in which ink is ejected as ink droplets, and relates more specifically to an ink jet head for ejecting ink as ink droplets and an ink jet recording apparatus using the ink jet head.

As an ink jet recording system in which ink is ejected as ink droplets, there have been known an electrostatic system in which electrostatic force is caused to act on ink to eject the ink as ink droplets, an electrothermal conversion system in which ink droplets are ejected by the pressure of vapor generated due to heat of a heating element, a piezoelectric system in which mechanical pressure pulse is generated by piezoelectric elements to eject ink droplets, and the like.

As the electrostatic ink jet recording system, there is a system in which ink containing charged fine particles is used, and ink ejection is controlled by utilizing electrostatic force through application of a predetermined voltage (drive voltage) to ejection electrodes (drive electrodes) of an ink jet head in correspondence with image data to record an image corresponding to the image data on a recording medium. For example, an ink jet recording apparatus disclosed in JP 10-138493 A is known as an apparatus using such electrostatic ink jet recording method.

FIG. 12 is a schematic structural view of an example of an ink jet head of the electrostatic ink jet recording apparatus disclosed in JP 10-138493 A. In an ink jet head 200 illustrated in FIG. 12, only one ejection portion of the ink jet head disclosed in JP 10-138493 A is conceptually illustrated. The illustrated ink jet head 200 includes a head substrate 202, an ink guide 204, an insulating substrate (ejection port substrate) 206, a control electrode (ejection electrode) 208, a counter electrode 210, a D.C. bias voltage source 212, and a pulse voltage source 214.

The ink guide 204 is disposed on the head substrate 202, and a through hole (ejection port) 216 is bored through the insulating substrate 206 at a position corresponding to the ink guide 204. The ink guide 204 extends through the through hole 216, and a convex tip end portion 204*a* thereof protrudes above the surface of the isulating substrate 206 on a recording medium P side. The head substrate 202 and the insulating substrate 206 are arranged to have a predetermined gap therebetween to form a flow path 218 of ink Q.

The control electrode 208 is arranged in a ring shape so as to surround the through hole 216 on the surface of the insulating substrate 206 on the recording medium P side for each ejection portion. The control electrode 208 is connected to the pulse voltage source 214 which generates a pulse voltage according to the image data, and the pulse voltage source 214 is grounded through the D.C. bias voltage source 212.

The counter electrode 210 is arranged at a position opposing the tip end portion 204*a* of the ink guide 204, and is grounded. The recording medium P is disposed on the surface of the counter electrode 210 on the ink guide 204 side. That is, the counter electrode 210 functions as a platen for supporting the recording medium P.

Upon recording, the ink Q containing fine particles (colorant particles) charged to the same polarity as that of the voltage to be applied to the control electrode 208 is circulated by a not shown ink circulation mechanism in a direction from the right side to the left side in the ink flow path 218 in FIG. 12. For example, a high voltage of 1.5 kV is always applied to the control electrode 208 by the D.C. bias voltage source 212. At this time, a part of the ink Q in the ink flow path 218 passes through the through hole 216 in the insulating substrate 206 due to the capillary phenomenon or the like, and is concentrated at the tip end portion 204*a* of the ink guide 204.

When the pulse voltage source 214 supplies the control electrode 208 biased to 1.5 kV by the bias voltage source 212 with a pulse voltage of, for example, 0V, the voltage of 1.5 kV obtained by superposition of the pulse voltage on the bias voltage is applied to the control electrode 208. In this state, the electric field strength near the tip end portion 204*a* of the ink guide 204 is relatively low, so that the ink Q containing colorant particles which are concentrated at the tip end portion 204*a* of the ink guide 204 is not ejected from the tip end portion 204*a*.

On the other hand, when the pulse voltage source 214 supplies a pulse voltage of, for example, 500V, to the control electrode 208 which is biased to 1.5 kV, the voltage of 2 kV obtained by superposition of the pulse voltage on the bias voltage is applied to the control electrode 208. Consequently, the ink Q containing colorant particles which are concentrated at the tip end portion 204*a* of the ink guide 204 flies as ink droplets R from the tip end portion 204*a* due to electrostatic force, and is attracted to the grounded counter electrode 210 to adhere to the recording medium P, thereby forming dots of colorant particles.

In this way, recording is performed with dots of colorant particles while relatively moving the ink jet head 200 and the recording medium P supported on the counter electrode 210, thereby recording an image corresponding to the image data on the recording medium P.

In the recording apparatus which uses the ink jet recording system in which ink droplets are ejected from the ejection port (through hole) 216, specially, the electrostatic ink jet recording system, responsivity in ejecting ink droplets can be improved by maintaining a meniscus formed at the ejection port 216 during ink ejection large in height.

A meniscus formed at the ejection port 216 can be maintained large in height by making the opening area of the ejection port 216 larger.

However, when the opening area of the ejection port 216 is made larger, ink flow path resistance at the ejection port 216 is reduced, which leads to a problem that ejection of ink droplets is not stopped even when an ejection signal is stopped, i.e., even when the control electrode 208 transfers from the state where a voltage of 500V is applied from the pulse voltage source 214 to the state where a voltage of 0V is applied from the pulse voltage source 214. That is, the ink ejection cutoff property (ink is not ejected after the end of a drive voltage application) is deteriorated (impaired). Deterioration of the ink ejection cutoff property may cause an error in ejection of ink droplets or the like, thereby raising a problem in that ejection of ink droplets cannot be stably controlled.

SUMMARY OF THE INVENTION

In order to solve the problems of the above conventional technique, it is an object of the present invention is to provide an ink jet head having high ink ejection cutoff property and high ejection responsivity, and capable of stably drawing an image at high speed.

Another object of the present invention is to provide an ink jet recording apparatus using the ink jet head.

According to the present invention, the opening is formed so that the opening area of the outer opening is larger than that of the inner opening, whereby the ejection responsivity and the ink ejection cutoff property can be enhanced, enabling a high quality image to be drawn at high speed. Further, the inner opening is anisotropic in shape, so that the capability of supplying ink to the ejection port can be enhanced.

DETAILED DESCRIPTION OF THE PREFERRED EMBODIMENTS

Hereinafter, an ink jet head and an ink jet recording apparatus of the present invention will be described in detail based on preferred embodiments illustrated in the accompanying drawings.

Figure 1A:
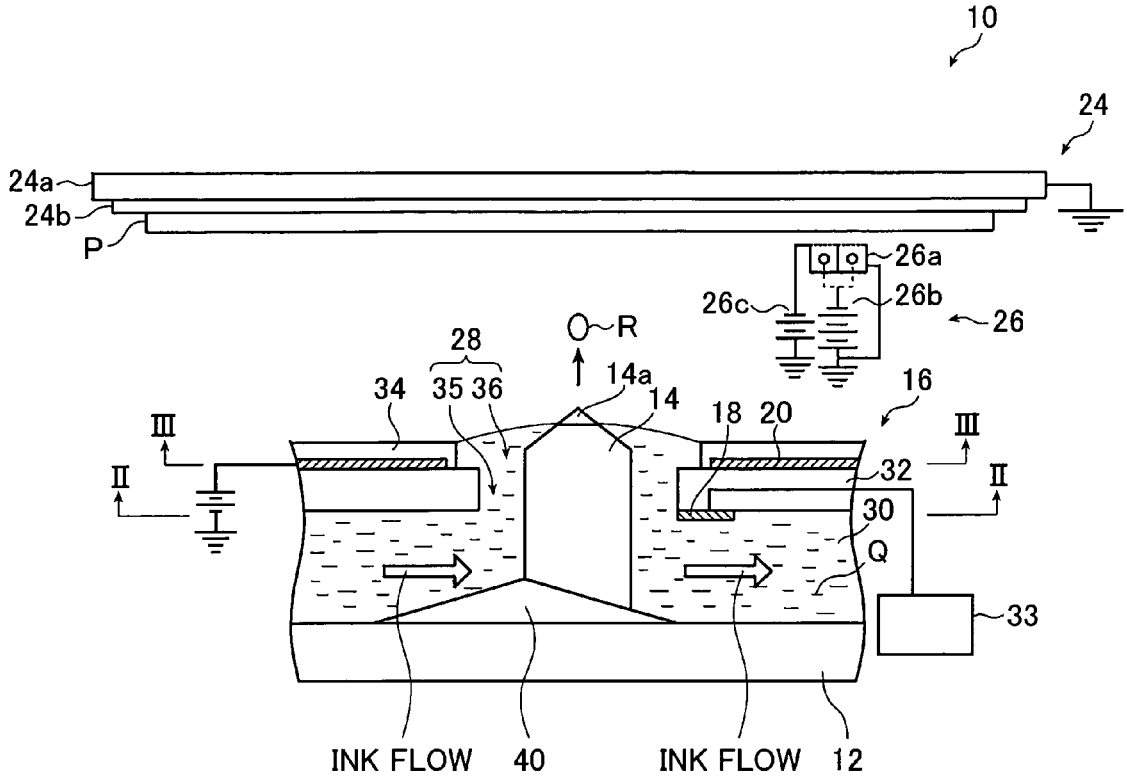
FIG. 1A is a schematic structural view showing one embodiment of an ink jet head of the present invention.
Figure 1B:
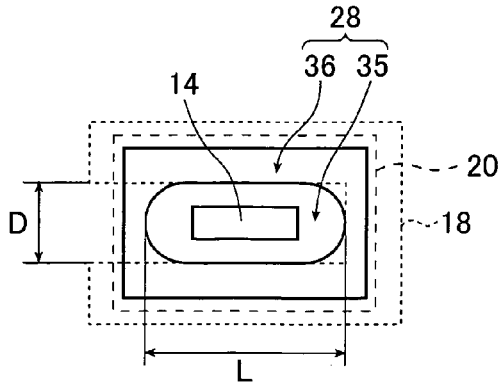
FIG. 1B is a top view of an ejection port substrate in the ink jet head in FIG. 1A.

FIG. 1A is a cross sectional view schematically showing an outlined structure of the ink jet head according to the present invention, and FIG. 1B is a top view of an ejection port substrate 16 shown in FIG. 1A. As shown in FIG. 1A, an ink jet head 10 includes a head substrate 12, ink guides 14, and an ejection port substrate 16 in which ejection ports 28 are formed. The ejection port substrate 16 has ejection electrodes 18 disposed so as to surround the respective ejection ports 28. At positions facing a surface on an ink ejection side (upper surface in FIG. 1A) of the ink jet head 10, a counter electrode 24 supporting a recording medium P and a charging unit 26 for charging the recording medium P are disposed.

Also, the head substrate 12 and the ejection port substrate 16 are disposed so that they face each other with a predetermined distance therebetween. By a space formed between the head substrate 12 and the ejection port substrate 16, an ink flow path 30 for supplying ink to each ejection port 28 is formed. An ink circulation device (ink circulation means) to be described later causes the ink in the ink flow path 30 to flow at a predetermined flow rate in a specific direction (in an arrow direction in FIG. 1A).

Figure 2:
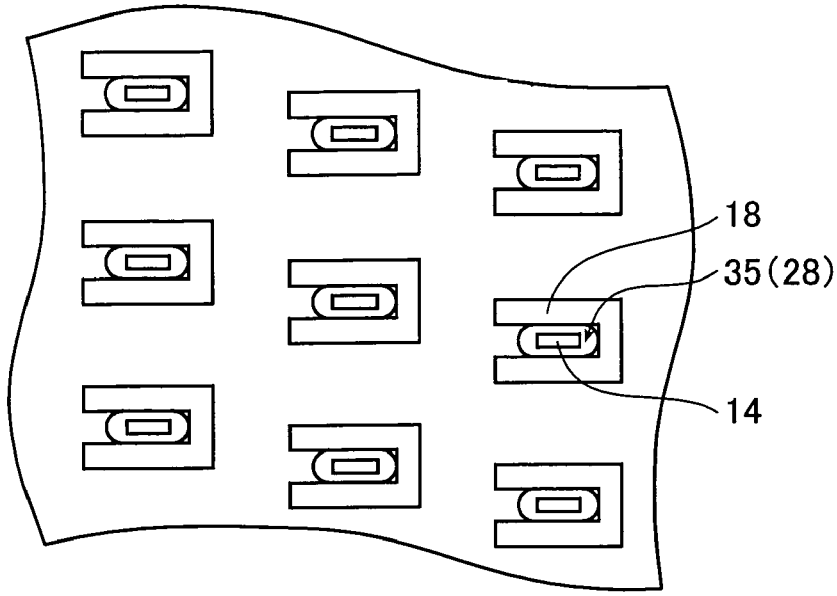
FIG. 2 is a view schematically showing a state where multiple ejection ports are two-dimensionally arranged in the ejection port substrate of the ink jet head.

In order to perform image recording at a higher density and at high speed, the ink jet head 10 has a multi-channel structure in which multiple ejection ports (nozzles) 28 are arranged in a two-dimensional manner. In FIG. 2, a state is schematically shown in which multiple ejection ports 28 are two-dimensionally formed in the ejection port substrate 16 of the ink jet head 10. In FIGS. 1A and 1B, in order to clarify the structure of the ink jet head, only one of the multiple ejection ports of the ink jet head 10 is shown.

In the ink jet head 10 according to the present invention, it is possible to freely choose the number of the ejection ports 28 in the ink jet head 10 and the physical arrangement position thereof. For example, the structure may be the multi channel structure of the embodiment shown in FIG. 2 or a structure having only one line of the ejection ports. The ink jet head 10 may be a so-called (full-)line head having lines of ejection ports corresponding to the whole area of the recording medium P or a so-called serial head (shuttle type head) which performs scanning in a direction perpendicular to the nozzle row direction. The ink jet head 10 can cope with a monochrome recording apparatus and a color recording apparatus.

It should be noted here that FIG. 2 shows an arrangement of the ejection ports in a part (three rows and three columns) of the multi-channel structure and, as a preferable form, the ejection ports 28 on a row on a downstream side in an ink flow direction are disposed so that they are displaced from the ejection ports on a row on an upstream side in the ink flow direction by a predetermined pitch in a direction perpendicular to the ink flow. By disposing the ejection ports on the row on the downstream side in the ink flow direction in this manner, it becomes possible to favorably supply ink to the ejection ports. In the ink jet head according to the present invention, a structure may be used in which an ejection port matrix with n rows and m columns (n and m are each a positive integer), in which ejection ports on a row on the downstream side are disposed so that they are displaced from ejection ports on a row on the upstream side in the direction perpendicular to the ink flow direction, is repeatedly provided in a constant cycle in the ink flow direction, or a structure may be used instead in which the ejection ports are disposed so that they are successively displaced from ejection ports, which are positioned on the upstream side, in one direction (downward direction or upward direction in FIG. 2) perpendicular to the ink flow. It is possible to appropriately set the number, pitch, and repetition cycle of the ejection ports and the like in accordance with a resolution and a feeding pitch.

Also, in FIG. 2, as a preferable form, the ejection ports on the row on the downstream side in the ink flow direction are disposed so that they are displaced from the ejection ports on the row on the upstream side in the direction perpendicular to the ink flow, however, the present invention is not limited to this, and the ejection ports on the downstream side and the ejection ports on the upstream side may be disposed on the same straight line in the ink flow direction. In this case, in view of ink supplying property, it is preferable that each ejection port on each row be disposed so that an ejection port is displaced in the ink flow direction from another ejection port which is adjacent to the ejection port in the direction vertical to the ink flow.

It is possible to appropriately set the arrangement pattern of the ejection ports in accordance with the structure of each ejection portion (e.g., shapes of the ejection port, ink guide and ejection electrode), the drive system of each ejection portion (e.g., thermal type, piezoelectric type). The arrangement pattern can also be appropriately set in accordance with the scanning system of the ink jet head 10 and/or the recording medium P.

In such ink jet head 10, the ink Q is used in which fine particles containing a colorant such as pigment, and having electrical charges (hereinafter referred to as the "colorant particles") are dispersed in an insulative liquid (carrier liquid). Also, an electric field is generated at the ejection port 28 through application of a drive voltage to the ejection electrode 18 provided in the ejection port substrate 16, and the ink at the ejection port 28 is ejected by means of electrostatic force. Further, by turning ON/OFF the drive voltage applied to the ejection electrode 18 in accordance with image data (ejection ON/OFF), the ink droplets are ejected from the ejection port 28 in accordance with the image data and an image is recorded on the recording medium P.

Hereinafter, the structure of the ink jet head 10 of the present invention used in the ink jet recording apparatus of the present invention will be described in more detail by referring to FIGS. 1A and 1B.

As shown in FIG. 1A, the ejection port substrate 16 of the ink jet head 10 includes an insulating substrate 32, a shield electrode 20, and an insulating layer 34. On a surface on an upper side in FIG. 1A (surface opposite to a side facing the head substrate 12) of the insulating substrate 32, the shield electrode 20 and the insulating layer 34 are laminated in order.

Also, on a lower surface side in FIG. 1A (surface on the side facing the head substrate 12) of the insulating substrate 32, the ejection electrode 18 is formed.

The ejection port 28 is formed to extend through the ejection port substrate 16 and ejects the ink droplets R. The ejection port 28 includes an inner opening (ejection opening) 35 formed to extend through the insulating substrate 32 and an outer opening (pinning opening) 36 formed to extend through the insulating layer 34.

As shown in FIG. 1B, the inner opening 35 is in the shape of a square which is elongated in the ink flow direction and whose both short sides are in semicircular shape, that is, a cocoon shaped opening (slit). More specifically, the inner opening 35 has a noncircular shape in which an aspect ratio (L/D) between a length L in the ink flow direction and a length D in a direction orthogonal to the ink flow is 1 or more. The inner wall formed in the inner opening 35 has a surface parallel to a thickness direction of the ejection port substrate 16, that is, the shape of the cross section of the inner opening 35 taken along the plane orthogonal to the thickness direction of the ejection port substrate 16 does not change along the thickness direction.

As shown in FIG. 1B, the outer opening 36 is a rectangular shaped opening (slit) having an opening area larger than that of the inner opening 35. The inner wall formed in the outer opening 36 has also a surface parallel to the thickness direction of the ejection port substrate 16, that is, the shape of the cross section of the outer opening 36 taken along the plane orthogonal to the thickness direction of the ejection port substrate 16 also does not change along the thickness direction.

As above, the ejection port 28 has a shape in which the inner opening 35 and the outer opening 36 having different opening areas are connected to each other, i.e., a stepped shape so that the opening area becomes larger toward the recording medium P side from the ink flow path 30 side. That is, the ejection port 28 is formed such that a part of the upper surface of the insulating substrate 32 on the recording medium P side is exposed in a junction interface of the substrate 32 and the layer 34. Therefore, the ejection port 28 has a shape in which the outer opening 36 is larger than the inner opening 35.

The ejection port 28 is formed in the shape in which the outer opening 36 is larger than the inner opening 35, so that it is possible to prevent deterioration (degradation) of the ink ejection cutoff property, and improve the ejection responsivity. This point will be described later in detail together with the ink droplet ejection action.

In the present invention, as a preferable form, it is possible to use an ink jet head having an opening whose aspect ratio (L/D) between the length L in the ink flow direction and the length D in the direction orthogonal to the ink flow is 1 or more (an anisotropic shape with its long sides extending in the ink flow direction, or a long hole with its long sides extending in the ink flow direction) as the opening of the ejection port 28 on the ink flow path 30 side, that is, the inner opening 35, so that ink becomes easy to flow to the ejection port 28. That is, the capability of supplying ink particles to the ejection port 28 is enhanced, which makes it possible to improve the frequency responsivity and also prevent clogging. This point will be described later in detail together with the ink droplet ejection action.

In this embodiment, the inner opening 35 is formed as the elongated cocoon-shaped opening, however, the present invention is not limited to this and it is possible to form the inner opening 35 in another arbitrary shape, such as a circular shape or a noncircular shape, so long as it is possible to eject ink from the ejection port 28. Specially, examples of the noncircular shape include any arbitrary shapes such as an oval shape, a rectangular shape, a rhomboid shape and a parallelogram shape, so long as the aspect ratio between the maximum length (that is, major axis) in a length direction of the opening (longitudinal direction) and the minimum length (that is, minor axis) in a direction orthogonal to the length direction is 1 or more. For instance, the inner opening 35 may be formed in a rectangular shape whose long sides extend in the ink flow direction, or an oval shape or a rhomboid shape whose major axis extends in the ink flow direction. Also, the inner opening 35 may be formed in a trapezoidal shape with its upper base being on the upstream side of the ink flow, its lower base being on the downstream side, and its height in the ink flow direction being set longer than the lower base. In this case, it does not matter whether the side on the upstream side is longer than the side on the downstream side or the side on the downstream side is longer than the side on the upstream side. Further, a shape may be formed in which to each short side of a rectangle whose long sides extend in the ink flow direction, a circle whose diameter is longer than the short side of the rectangle is connected. Also, the inner opening 35 may be formed so that the upstream side and the downstream side are symmetric or asymmetric with respect to the center thereof. For example, at least one of end portions on the upstream side and the downstream side of the rectangular ejection port may be formed in a semicircular shape to obtain the inner opening.

The ink guide 14 of the ink jet head 10 is produced from a ceramic-made flat plate with a predetermined thickness, and is disposed on the head substrate 12 for each ejection port 28 (ejection portion). The ink guide 14 is formed so that it has a somewhat wide width in accordance with the length of the cocoon-shaped inner opening 35 in a long-side direction. As described above, the ink guide 14 extends through the ejection port 28 and its tip end portion 14*a* protrudes upwardly from the surface of the ejection port substrate 16 on the recording medium P side (surface of the insulating layer 34).

The tip end portion 14*a* of the ink guide 14 is formed so that it has an approximately triangular shape (or a trapezoidal shape) that is gradually narrowed as a distance to the counter electrode 24 side is reduced. The ink guide 14 is disposed so that the surface of the tip end portion 14*a* is inclined with respect to the ink flow direction. With this configuration, the ink flowing into the ejection port 28 moves along the inclined surface of the tip end portion 14*a* of the ink guide 14 and reaches the vertex of the tip end portion 14*a*, so a meniscus of ink is formed at the ejection port 28 with stability.

Also, by forming the ink guide 14 so that it is wide in the long-side direction of the ejection port 28, it becomes possible to reduce a width in the direction orthogonal to the ink flow and reduce influence on the ink flow, which makes it possible to form a meniscus to be described later with stability.

It should be noted here that the shape of the ink guide 14 is not specifically limited so long as it is possible to move the colorant particles in the ink Q through the ejection port 28 of the ejection port substrate 16 to be concentrated at the tip end portion 14*a*. For instance, it is possible to change the shape of the ink guide 14 as appropriate to a shape other than the shape in which the tip end portion 14*a* is gradually narrowed toward the counter electrode side. For instance, a slit serving as an ink guide groove that guides the ink Q to the tip end portion 14*a* by means of a capillary phenomenon may be formed in a center portion of the ink guide 14 in a vertical direction in FIG. 1A.

Also, it is preferable that a metal be evaporated onto the extreme tip end portion of the ink guide 14 because the dielectric constant of the tip end portion 14*a* of the ink guide 14 is substantially increased through the evaporation of the metal onto the extreme tip end portion of the ink guide 14. As a result, a strong electric field is generated at the ink guide 14 with ease, which makes it possible to improve the ink ejection property.

As shown in a dotted line in FIG. 1B, under the lower surface (surface facing the head substrate 12) of the insulating substrate 32, the ejection electrode 18 is formed. The ejection electrode 18 has a reversed C-letter shape in which one side of a rectangle on the upstream side in the ink flow direction is removed, and is disposed along the rim of the inner opening 35 so as to surround the periphery of the cocoon-shaped inner opening 35. In FIG. 1B, the ejection electrode 18 is formed in a reversed C-letter shape, however, it is possible to change the shape of the ejection electrode 18 to various other shapes so long as the ejection electrode is disposed to face the ink guide. For example, the ejection electrode 18 may be a ring shaped circular electrode, an oval electrode, a divided circular electrode, a parallel electrode or a substantially parallel electrode, corresponding to the shape of the inner opening 35.

As described above, the ink jet head 10 has a multi channel structure in which multiple ejection ports 28 are arranged in a two-dimensional manner. Therefore, as schematically shown in FIG. 2, the ejection electrodes 18 are respectively disposed for the ejection ports 28 in a two-dimensional manner.

Also, the ejection electrodes 18 are exposed to the ink flow path 30 and contact the ink Q flowing in the ink flow path 30. Thus, it becomes possible to significantly improve the ink droplets ejecting property. This point will be described in detail later together with the ink droplet ejection action. The ejection electrode 18 is not necessarily required to be exposed to the ink flow path 30 and contact the ink. For instance, the ejection electrode 18 may be formed in the ejection port substrate 16 or the surface of the ejection electrode 18 exposed to the ink flow path 30 may be covered with a thin insulating layer.

As shown in FIG. 1A, the ejection electrode 18 is connected to a control unit 33 which is capable of controlling a voltage applied to the ejection electrode 18 at the time of ejection and non-ejection of ink.

Figure 3:
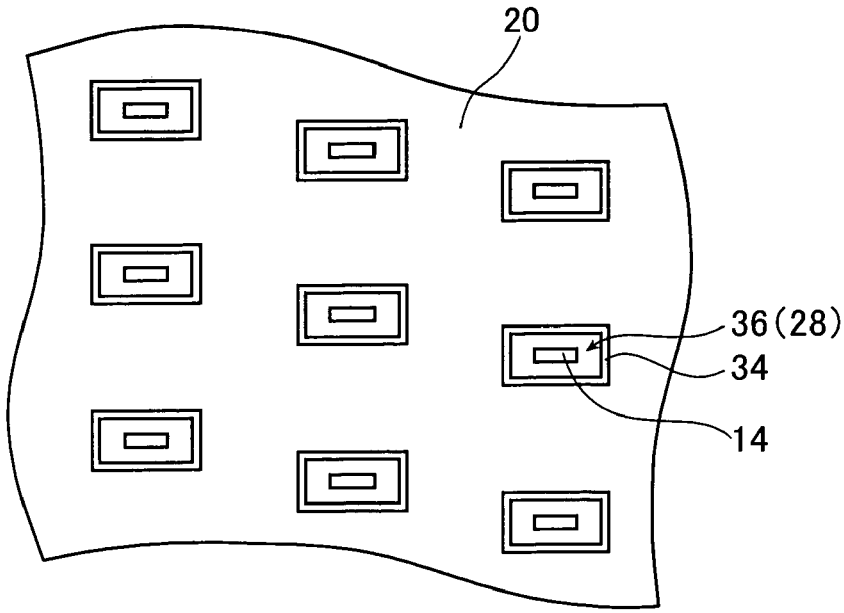
FIG. 3 is a view schematically showing a planar structure of a shield electrode in the ink jet head having a multi channel structure.

The shield electrode 20 is formed on the surface of the insulating substrate 32, and the surface of the shield electrode 20 is covered with the insulating layer 34. In FIG. 3, a planar structure of the shield electrode 20 is schematically shown. FIG. 3 is a view taken along the line III-III in FIG. 1A and schematically shows the planar structure of the shield electrode 20 of the ink jet head having a multi channel structure. As shown in FIG. 3, the shield electrode 20 is a sheet-shaped electrode, such as a metallic plate, which is common to each ejection electrode and has openings at positions corresponding to the ejection electrodes 18 respectively formed on the peripheries of the inner openings 35 arranged in a two-dimensional manner. Each of the openings is formed in a rectangular shape. Here, each of the openings of the shield electrode 20 is formed so that it has a length and a width exceeding the length and the width of the outer opening 36.

It is possible for the shield electrode 20 to suppress electric field interference by shielding against electric lines of force between adjacent ejection electrodes 18, and a predetermined voltage (including 0v when grounded) is applied to the shield electrode 20.

As a preferred embodiment, as shown in FIG. 1A, the shield electrode 20 is formed in a layer different from that containing the ejection electrodes 18, and moreover, its whole surface is covered with the insulating layer 34.

The ink jet head 10 has such shield electrode 20, whereby electric field interference between adjacent ejection electrodes 18 can be suitably prevented. Moreover, the ink jet head 10 has the insulating layer 34, whereby discharging between the ejection electrode 18 and the shield electrode 20 can also be prevented even when the colorant particles of the ink Q are formed into a coating.

Here, the shield electrode 20 needs to be provided so as to block the electric lines of force of the ejection electrodes 18 provided on other ejection ports 28 (hereinafter referred to as "other channels") and the electric lines of force directed to the other channels while ensuring the electric lines of force acting on the corresponding ejection port 28 (hereinafter referred to as "own channel" for convenience) among the electric lines of force generated from the ejection electrodes 18.

When the shield electrode 20 is not provided, at the time of ejection of ink droplets, the electric lines of force generated from the end portion on an ejection port side of the ejection electrode 18 (hereinafter referred to as the "inner edge portion of the ejection electrode") converge inside the ejection electrode 18, that is, in the area surrounded by the inner edge portion of the ejection electrode 18, act on the own channel, and generate an electric field necessary for the ink droplet ejection. On the other hand, the electric lines of force generated from the end portion on a side opposite to the ejection port side of the ejection electrode 18 (hereinafter referred to as the "outer edge portion of the ejection electrode") diverge further outside from the outer edge portion of the ejection electrode 18, exert influence on other channels, and cause electric field interference.

If the above points are taken into consideration, the width and the length of the rectangular opening of the shield electrode 20, when the substrate plane is viewed from above, is preferably made larger than the width and the length defined by the inner edge portion of the ejection electrode 18 of the own channel to avoid shielding against the electric lines of force directed to the own channel. Specifically, the end portion of the shield electrode 20 on the ejection port 28 side is preferably more spaced apart (retracted) from the ejection port 28 than the inner edge portion of the ejection electrode 18 of the own channel.

In addition, for the efficient shielding against the electric lines of force directed to the other channels, the length and the width of the rectangle opening of the shield electrode 20, when the substrate plane is viewed from above, is preferably made smaller than the length and the width defined by the outer edge portion of the ejection electrode 18 of the own channel. Specifically, the end portion of the shield electrode 20 on the ejection port 28 side is preferably closer (advanced) to the ejection port 28 than the outer edge portion of the ejection electrode 18 of the own channel. According to the studies made by the inventors of the present invention, the distance between the outer edge portion of the ejection electrode 18 and the end portion of the shield electrode 20 is preferably equal to or larger than 5 μm, more preferably equal to or larger than 10 μm.

With the above construction, stability in ejecting ink droplets from the ejection port 28 is ensured, variations in an ink adhering position due to electric field interference between adjacent channels can be suitably suppressed, and thus a high-quality image can be consistently recorded.

The shield electrode 20 may be provided (that is, the openings of the shield electrode 20 may be formed) so that the shape of each opening of the shield electrode 20 is made substantially similar to the shape formed by the inner edge portion or the outer edge portion of the ejection electrode 18, and the opening edge of the shield electrode 20 is more spaced apart (retracted) from the ejection port 28 than the inner edge portion of the ejection electrode 18 of the own channel and is closer (advanced) to the ejection port 28 than the outer edge portion of the ejection electrode 18.

Also, in the above example, the shield electrode 20 is a sheet-shaped electrode, however, the present invention is not limited to this and the shield electrode 20 may have any other shapes or structures so long as it is possible to shield the respective ejection ports against the electric lines of force of other channels. For instance, the shield electrode 20 may be provided between respective ejection ports in a mesh shape. Also, when the intervals between the adjacent ejection ports in the row direction and the intervals between the adjacent ejection ports in the column direction are different from each other in the matrix of the multiple ejection ports, for instance, a structure may be used in which the shield electrode is not provided between ejection ports, which are separated from each other to such a degree that no electric field interference will occur, and the shield electrode is provided only between ejection ports that are close to each other.

Even in this case, it is sufficient that the shield electrode 20 is formed so that the opening edge of the shield electrode 20 is more spaced apart from the ejection port 28 than the inner edge portion of the ejection electrode 18 of the own channel and is closer to the ejection port 28 than the outer edge portion of the ejection electrode 18 of the own channel.

The shape of each opening of the shield electrode 20 is approximately the same as the shape of the ejection port 28, however, the present invention is not limited to this and the openings of the shield electrode 20 may have another arbitrary shape so long as it is possible to prevent electric field interference by shielding against electric lines of force between adjacent ejection electrodes 18. For instance, it is possible to form each opening of the shield electrode 20 in a circular shape, an oval shape, a square shape, a rectangle shape, or a rhomboid shape.

In the ink jet head 10 in this embodiment, as a preferable form, an ink guide dike 40 that guides ink to the ejection port 28 is provided on the head substrate 12. The ink guide dike 40 will be described below.

Figure 4A:
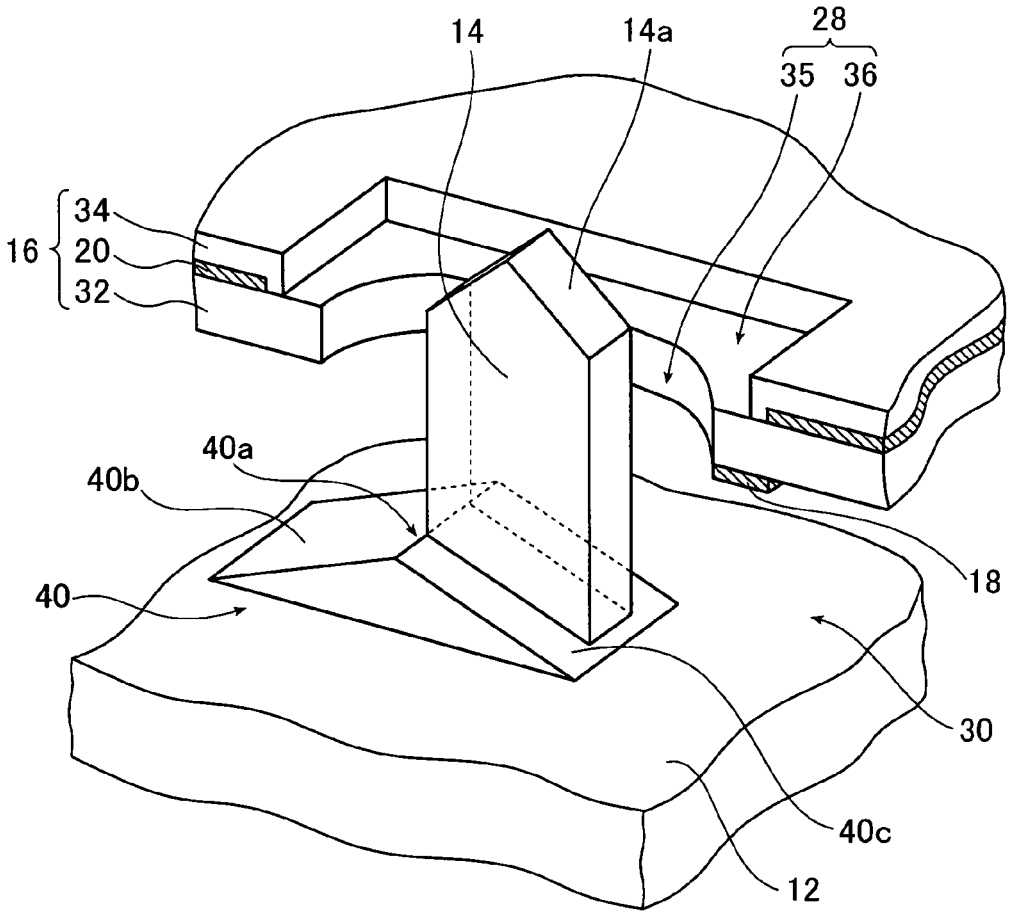
FIG. 4A is a partial cross sectional perspective view showing a structure in the vicinity of the ejection portion in the ink jet head shown in FIG. 1A.
Figure 4B:
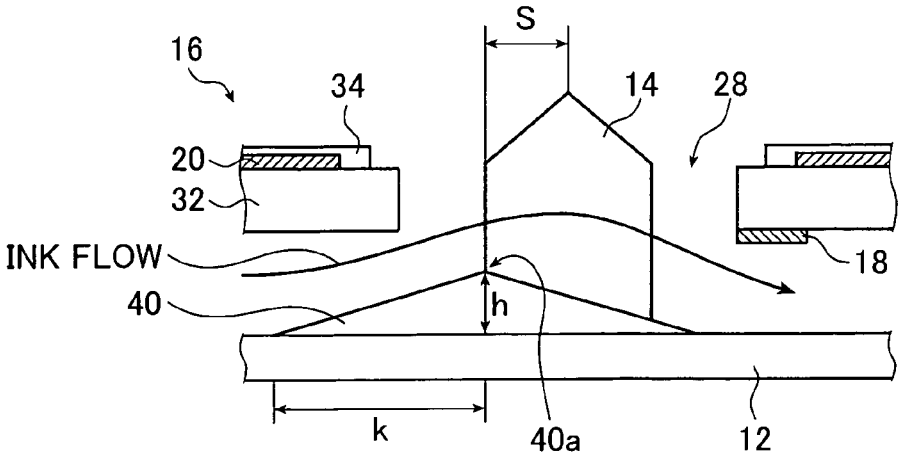
FIG. 4B is a cross sectional view illustrating the geometry of an ink guide dike.

FIG. 4A is a partial cross sectional perspective view showing a structure in the vicinity of the ejection portion in the ink jet head 10 shown in FIG. 1A. In FIG. 4A, in order to demonstrate clearly the structure of the ink guide dike 40, the vicinity of one ejection port 28 is shown by cutting the ejection port substrate 16 and the ejection electrode 18 along the ink flow direction at the substantially central position of the ink guide 14. FIG. 4B is a cross sectional view corresponding to FIG. 4A taken along a plane which passes through the center of the ejection port 28 and is parallel to the ink flow direction and the thickness direction of the ejection port substrate.

The ink guide dike 40 is disposed on the surface of the head substrate 12 on the ink flow path 30 side, i.e., on the bottom surface of the ink flow path 30, at a position corresponding to the ejection port 28. In the illustrated example, the ink guide dike 40 has an inclined surface 40*b* which inclines so as to become gradually closer to the ejection port substrate 16 from the upstream side of ink flow in the ink flow path 30 toward a predetermined position 40*a* (hereinafter referred to as "top portion 40*a*") which is on the upstream side from the center of the ejection port 28 in the ink flow direction. As a preferable form, the ink guide dike 40 has an inclined surface 40*c* which inclines so as to be gradually spaced apart from the ejection port substrate 16 as the distance from the top portion 40*a* at which the inclined surface 40*b* is closest to the ejection port substrate 16 toward the downstream side of the ink flow in increased. That is, in the illustrated example, the ink guide dike 40 has a shape like an isosceles triangular prism with the bases of the isosceles triangles being on the head substrate 12 and its side formed by two vertex angles of the isosceles triangles constituting the top portion 40*a*.

In addition, the ink guide dike 40 is constructed so as to have nearly the same width as that of the inner opening in a direction intersecting perpendicularly the ink flow direction, and have a side wall which is erected on the bottom face. In addition, the ink guide dike 40 is provided at a predetermined distance from the surface of the ejection port substrate 16 on the ink flow path 30 side, i.e., from the upper surface of the ink flow path 30 so as to ensure the flow path of the ink Q without blocking up the ejection port 28. Such ink guide dike 40 is provided for the respective ejection portions.

The ink guide dike 40 inclining toward the ejection port 28 is provided on the bottom surface of the ink flow path 30 along the ink flow direction, whereby the ink flow directed to the ejection port 28 is formed and hence the ink Q is guided to the opening of the ejection port 28 on the ink flow path 30 side. Thus, it is possible to suitably make the ink Q to flow to the inside of the ejection port 28, enabling enhancement of the ink particles supplying property. Further, it is possible to more surely prevent the ejection port 28 from being clogged.

Further, the ink guide dike 40 in this embodiment is disposed so that the top portion 40*a* thereof is positioned on the upstream side from the center of the ejection port 28 in the ink flow direction. In the example shown in FIG. 4B, the top portion 40*a* of the ink guide dike 40 is shifted (offset) by a distance s to the upstream side from the center of the ejection port 28.

As above, the top portion 40*a* is shifted to the upstream side from the center of the ejection port 28. Thus, when the ink flow rate is increased, the ink flow toward the central portion of the ejection port 28 is formed, so that it is possible to enhance the ink supplying property to the ejection port 28. Further, it is possible to more surely prevent the ejection port 28 from being clogged.

The ink guide dike 40 is provided with the inclined surface 40*b*, so that the height of the ink flow path 30 on the upstream side from the ejection port 28 (space between the ejection port substrate 16 and the inclined surface 40*b*) is gradually decreased as the inclined surface 40*b* approaches the ejection port 28. On the other hand, the height of the ink flow path 30 on the downstream side of the ejection port 28 is gradually increased and higher than the uptream side. With this structure, a turbulent flow of ink can be prevented, so that it is possible to enhance the effect of the ink supplying property.

It is sufficient that the shift amount s of the top portion 40*a* is determined so that the highest position of the ink flow guided along the inclined surface 40*b* in the thickness direction of the ejection port substrate 16 comes roughly to the center of the ejection port 28 in the ink flow direction. Thus, the shift amount s can be appropriately set in accordance with the flow rate (design flow rate) of the ink Q in the ink flow path 30, the cross sectional area of a space of the ejection port 28 and the shape of the ejection port 28, the shape of the ink guide 14, and the like. The flow rate of the ink Q in the ink flow path 30 is affected by the rate at which the ink Q is supplied (circulation rate), the cross sectional area and the shape of the ink flow path 30, the physical properties of the ink Q, and the like. The highest position of the ink flow is affected by the inclination angle and surface shape of the inclined surface 40*b* and the like. In view of these factors, the shift amount s of the top portion 40*a* is determined.

A length k of the ink guide dike 40 in the ink flow direction has to be properly set within a range in which the ink guide dike 40 does not interfere with any of the adjacent ejection ports so that the ink Q can be suitably guided to the ejection port 28. Thus, as shown in FIG. 4B, the length k of the ink guide dike 40 is preferably 0.5 or more times as large as a height h ($k/h \geqq 0.5$) of the highest portion of the ink guide dike 40, and is more preferably 1 or more times as large as the height h ($k/h \geqq 1$) of the highest portion of the ink guide dike 40.

The width of the ink guide dike 40 in the direction intersecting perpendicularly the ink flow direction is preferably equal to that of the ejection port 28 or slightly wider than that of the ejection port 28. In addition, the ink guide dike 40 is not limited to the illustrated example having a uniform width. Thus, there may also be adopted an ink guide dike having a gradually decreasing width, an ink guide dike having a gradually increasing width, or the like. In addition, each side wall of the ink guide dike 40 is not limited to the one having a vertical plane, and hence may also be the one having an inclined plane or the like.

The inclined surface (ink guide surface) of the ink guide dike 40 need only have a shape which is suitable for guiding the ink Q to the ejection port 28. Thus, a slope having a fixed angle of inclination may be adopted for the inclined surface of the ink guide dike 40. Or, a surface having different angles of inclination, or a curved surface may also be adopted for the inclined surface of the ink guide dike 40. In addition, the inclined surface of the ink guide dike 40 is not limited to a smooth surface. Thus, one or more ridges, grooves or the like may be formed along the ink flow direction, or radially toward the central portion of the ejection port 28 on the inclined surface of the ink guide dike 40.

The ink guide dike 40 may be made as a separate member from the head substrate 12 to be attached thereto, or may be formed as a part of the head substrate 12. That is, the ink guide dike 40 may have any arbitrary form so long as a part of the head substrate 12 has a raised shape so that the top portion thereof is positioned on the upstream side of the ejection port 28 in the ink flow direction at each ejection portion.

The ink guide dike 40 and the ink guide 14 may be formed as separate members so that the latter is connected to the former and mounted on the head substrate 12. Alternatively, the ink guide 14 and the ink guide dike 40 may be formed integrally with each other to be mounted on the head substrate 12. Still alternatively, the head substrate 12, the ink guide dike 40 and the ink guide 14 may be made from one piece of material using the conventionally known digging means (etching and the like). In addition, the perimeter of the bottom surface of the ink guide 14 may be rounded unlike the illustrated example to be smoothly connected to the upper surface of the ink guide dike 40.

In the illustrated example, the top portion 40*a* of the ink guide dike 40 accords with the surface of the ink guide 14 on the upstream side of the ink flow, however, the positional relation between the top portion 40*a* and the ink guide 14 is not limited thereto. For example, the top portion 40*a* may be positioned on the upstream side from the surface of the ink guide 14 on the upstream side of the ink flow so that the ink guide 14 is erected on the inclined surface 40*c* of the ink guide dike 40 which is on the downstream side in the ink flow direction. The top portion 40*a* may be positioned between the surface of the ink guide 14 on the upstream side of the ink flow and the vertical plane passing through the vertex of the tip end portion 14*a* of the ink guide 14. The ink guide 14 is disposed so that the tip end portion 14*a* is positioned roughly in the center of the ejection port 28, and the ink guide dike 40 is disposed so that the highest position of the ink flow guided by the ink guide dike 40 comes roughly to the center of the ejection port 28 in the ink flow direction.

It should be noted that while the ink guide dike 40 has to be provided with the inclined surface 40*b*, as in the illustrated example, the ink guide dike 40 is preferably provided with the inclined surface 40*c* inclining so that the distance from the ejection port substrate 16 is gradually increased as the distance from the top portion 40*a* is increased toward the downstream side. As a result, the ink Q which has been guided toward the ejection port 28 by the ink guide dike 40 on the upstream side smoothly flows to the downstream side. Hence, the stability of ink flow can be maintained without a turbulent flow of the ink Q, enabling ejection stability to be maintained.

In the example shown in FIGS. 4A and 4B, the ink guide dike 40 is disposed on the upper surface of the head substrate 12. However, the present invention is not limited to this and there may also be adopted a structure in which an ink flow groove is provided in the head substrate 12, and the ink guide dike is disposed inside the ink flow groove.

For example, the ink flow groove having a predetermined depth is provided so as to extend through a position corresponding to the ejection port 28 along the ink flow direction. Further, there is provided an ink guide dike having the surface inclining toward the ejection port 28 along the ink flow direction in the position corresponding to the ejection port. In such a manner, the provision of the ink flow groove allows most of the ink Q flowing through the ink flow path 30 to selectively flow in the ink flow groove, and the provision of the ink guide dike allows the ink Q to suitably flow to the inside of the ejection port 28. Hence, it is possible to enhance the ink supplying property to the tip end portion 14*a* of the ink guide 14.

As shown in FIG. 1A, the counter electrode 24 is disposed so as to be opposed to the surface of the ink jet head 10 from which the ink droplets R are ejected.

The counter electrode 24 is disposed at a position facing the tip end portion 14*a* of the ink guide 14, and includes an electrode substrate 24*a* which is grounded, and an insulating sheet 24*b* which is disposed on the lower surface of the electrode substrate 24*a* in FIG. 1A, that is, on the surface of the electrode substrate 24*a* on the ink jet head 10 side.

The recording medium P is supported on the lower surface of the counter electrode 24 in FIG. 1A, that is, on the surface of the insulating sheet 24*b* by electrostatic attraction for example. The counter electrode 24 (the insulating sheet 24*b*) functions as a platen for the recording medium P.

At least during recording, the recording medium P held on the insulating sheet 24*b* of the counter electrode 24 is charged by the charging unit 26 to a predetermined negative high voltage opposite in polarity to that of the drive voltage applied to the ejection electrode 18.

As a result, the recording medium P is charged negative to be biased to the negative high voltage to function as the substantial counter electrode to the ejection electrode 18, and is electrostatically attracted to the insulating sheet 24*b* of the counter electrode 24.

The charging unit 26 includes a scorotron charger 26*a* for charging the recording medium P to a negative high voltage, a high voltage power source 26*b* for supplying a negative high voltage to the scorotron charger 26*a*, and a bias voltage source 26*c*. Note that the corona wire of the scorotron charger 26*a* is connected to the terminal of the high voltage power source 26*b* on the negative side, and the terminal of the high voltage power source 26*b* on the positive side and the metallic shield case of the scorotron charger 26*a* are grounded. The terminal of the bias voltage source 26*c* on the negative side is connected to the grid electrode of the scorotron charger 26*a*, and the terminal of the bias voltage source 26*c* on the positive side is grounded.

The charging means of the charging unit 26 used in the present invention is not limited to the scorotron charger 26*a*, and hence various discharge means such as a corotron charger, a solid-state charger and an electrostatic discharge needle can be used.

In addition, in the illustrated embodiment, the counter electrode 24 includes the electrode substrate 24*a* and the insulating sheet 24*b*, and the charging unit 26 is used to charge the recording medium P to a negative high voltage to apply a bias voltage to the medium P so that the medium P functions as the counter electrode and is electrostatically attracted to the surface of the insulating sheet 24*b*. However, this is not the sole case of the present invention and another configuration is also possible in which the counter electrode 24 is constituted only by the electrode substrate 24*a*, and the counter electrode 24 (electrode substrate 24*a*) is connected to a high voltage power source for supplying a negative high voltage and is always biased to the negative high voltage so that the recording medium P is electrostatically attracted to the surface of the counter electrode 24.

Further, the electrostatic attraction of the recording medium P to the counter electrode 24, the charge of the recording medium P to the negative high voltage, and the application of the negative high voltage to the counter electrode 24 may be performed using separate negative high voltage sources. Also, the support of the recording medium P by the counter electrode 24 is not limited to the utilization of the electrostatic attraction of the recording medium P, and hence any other supporting method or supporting means may be used for the support of the recording medium P by the counter electrode 24.

The present invention will be described in more detail below by describing the ejection action of the ink droplets R from the ink jet head 10.

As shown in FIG. 1A, in the ink jet head 10, the ink Q, which contains colorant particles charged with the same polarity (for example, charged positively) as that of a voltage applied to the ejection electrode 18 at the time of recording, circulates in an arrow direction (from left to right in FIG. 1A) in the ink flow path 30 by a not shown ink circulation mechanism including a pump and the like.

On the other hand, upon recording, the recording medium P is supplied to the counter electrode 24 and is charged to have the polarity opposite to that of the colorant particles, that is, a negative high voltage by the charging unit 26. While being charged to the bias voltage, the recording medium P is electrostatically attracted to the counter electrode 24.

In this state, the control unit 33 performs control so that a pulse voltage (hereinafter referred to as a "drive voltage") is applied to each ejection electrode 18 in accordance with supplied image data while relatively moving the recording medium P (counter electrode 24) and the ink jet head 10. Ejection ON/OFF is basically controlled depending on application ON/OFF of the drive voltage, whereby the ink droplets R are modulated in accordance with the image data and ejected to record an image on the recording medium P.

Here, when the drive voltage is not applied to the ejection electrode 18 (or the applied voltage is at a low voltage level), i.e., in a state where only the bias voltage is applied, Coulomb attraction between the bias voltage and the charges of the colorant particles (charged particles) of the ink Q, Coulomb repulsion among the colorant particles, viscosity, surface tension and dielectric polarization force of the carrier liquid, and the like act on the ink Q, and these factors operate in conjunction with one another to move the colorant particles and the carrier liquid. Thus, the balance is kept in a meniscus shape as conceptually shown in FIG. 1A in which the ink Q slightly rises from the outer opening 36.

In addition, the colorant particles aggregate at the ejection port 28 due to the electric field generated between the negatively charged recording medium P and the ejection electrode 18. The above described Coulomb attraction and the like allow the colorant particles to move toward the recording medium P charged to the negative bias voltage through a so-called electrophoresis process. Thus, the ink Q is concentrated in the meniscus formed at the outer opening 36.

From this state, the drive voltage is applied to the ejection electrode 18. Whereby, the drive voltage is superposed on the bias voltage. Then, the motion occurs in which the previous conjunction motion operates in conjunction with the superposition of the drive voltage. The electrostatic force acts on the colorant particles and the carrier liquid by the electric field newly generated by the application of the drive voltage to the ejection electrode 18. Thus, the colorant particles and the carrier liquid are attracted toward the counter electrode 24 side, i.e., the recording medium P side by the electrostatic force. The meniscus formed in the ejection port grows toward the recording medium P side (upward in FIG. 1A) to form a nearly conical ink liquid column, i.e., a so-called Taylor cone in a direction from the outer opening 36 to the recording medium P. In addition, similarly to the foregoing, the colorant particles are moved to the meniscus surface through electrophoresis process and the action of the electric field from the ejection electrode so that the ink Q at the meniscus is concentrated and has a large number of colorant particles at a nearly uniform high concentration.

When a finite period of time further elapses after the start of the application of the drive voltage to the ejection electrode 18, the balance mainly between the force acting on the colorant particles (Coulomb force and the like) and the surface tension of the carrier liquid is broken at the tip portion of the meniscus having the high electric field strength due to the movement of the colorant particles or the like. As a result, the meniscus abruptly grows to form a slender ink liquid column called a thread having about several μm to several tens of μm in diameter.

When a finite period of time further elapses, the thread grows, and is divided due to the interaction resulting from the growth of the thread, the vibrations generated due to the Rayleigh/Weber instability, the ununiformity in distribution of the colorant particles within the meniscus, the ununiformity in distribution of the electrostatic field applied to the meniscus, and the like. Then, the divided thread is ejected and flown in the form of the ink droplets R toward the recording medium P and is attracted by the bias voltage as well to adhere to the recording medium P.

The growth of the thread and its division, and moreover the movement of the colorant particles to the meniscus (thread) are continuously generated while the drive voltage is applied to the ejection electrode. Therefore, the amount of ink droplets ejected per pixel can be controlled by adjusting the time when the drive voltage is applied.

After the end of the application of the drive voltage (ejection is OFF), the meniscus returns to the above-mentioned state where only the bias voltage is applied to the recording medium P.

Here, as described above, the ink jet head 10 of the present invention includes the ejection ports each shaped so that the opening area of the outer opening 36 is larger than that of the inner opening 35. By making the opening area of the outer opening 36 in the ejection port 28 larger, it is possible to maintain a meniscus formed at the ejection port at the time of ink ejection large in height. Also, by making the opening area of the inner opening 35 smaller than that of the outer opening 36, it is possible to suppress reduction of the ink flow path resistance at the ejection port 28.

That is, even when the opening area of the outer opening 36 is set so that a meniscus has a height equal to or greater than a certain value, the ejection port 28 is shaped so that the opening area of the inner opening 35 is smaller than that of the outer opening 36, thereby enabling the ink flow path resistance to be made equal to or greater than a certain value. In other word, even when the opening area of the inner opening 35 is set so that the ink flow path resistance is equal to or greater than a certain value, the ejection port 28 is shaped so that the opening area of the outer opening 36 is larger than that of the inner opening 35, thereby enabling the meniscus to be made higher.

Here, the ink flow path resistance is the resistance created when ink passes through the ejection port 28. When the ink flow path resistance is reduced, the force for suppressing the ink flow becomes small. Thus, ejection of ink droplets is not stopped even in the ink ejection. OFF state, i.e., ink droplets are ejected even after the end of the application of the drive voltage. That is, the ink ejection cutoff property is deteriorated (impaired).

However, in the present invention, the ink flow path resistance can be set equal to or higher than a certain value as described above, so that the ink ejection cutoff property is prevented from being deteriorated (impaired). That is, the following phenomenon is prevented: ejection of ink droplets is not stopped even in the ink ejection OFF state, i.e., ink droplets are ejected even after the end of the application of the drive voltage. Consequently, it becomes possible to control ejection and non-ejection (ejection ON/OFF) of ink droplets more precisely, thereby enabling a high quality image to be drawn.

Further, a meniscus can be made high in position (a meniscus can have a height equal to or greater than a certain value), so that it is possible to improve the ejection responsivity (ejection frequency) of ink droplets. Consequently, ink droplets can be ejected at high ejection frequency.

As above, according to the present invention, ink droplets can be stably ejected at high speed, and a high quality image can be drawn. Specifically, even when image recording is performed at the ejection frequency of 15 kHz, it is possible to maintain high ink ejection cutoff property. Thus, a high quality image can be stably drawn.

It is preferable that the ratio of an opening area S1 of an inner opening (opening on the ink flow path side) to an opening are S2 of an outer opening (opening on the recording medium side) in the ejection port, be set at 1:10 to 1:2. That is, it is preferable that (S1/S2) be 0.1 or more and 0.5 or less.

As shown in FIGS. 1A and 1B, the ink jet head 10 has the inner opening 35 that is a slit like long hole elongated in the ink flow direction. By forming the inner opening 35 in the shape of a slit like long hole elongated in the ink flow direction, that is, by setting the aspect ratio of the inner opening 35 between the length in the ink flow direction and the length in the direction orthogonal to the ink flow at 1 or more, ink becomes easy to flow to the inside of the ejection port and the capability of supplying ink particles to the ejection port 28 can be enhanced. That is, the capability of supplying ink particles to the tip end portion 14*a* of the ink guide 14 is enhanced, which makes it possible to improve ejection frequency at the time of image recording. Therefore, even when dots are drawn continuously at high speed, dots of desired size can be consistently formed on the recording medium. In addition, by setting the aspect ratio of the inner opening at 1 or more, ink flows smoothly and the ejection port can be prevented from being clogged with ink.

It is preferable that the aspect ratio of the inner opening between the length in the ink flow direction and the length in the direction orthogonal to the ink flow direction be 1.5 or more.

By setting the aspect ratio at 1.5 or more, the capability of supplying ink to the ink guide can be enhanced. Thus, it is possible to continuously form large dots with more stability, and to perform drawing at a higher drawing frequency.

The above effects can be more advantageously achieved by forming the opening of the ejection port such that the aspect ratio between the length in the ink flow direction and the length in the direction orthogonal to the ink flow is 1 or more as in the above embodiment, however, the present invention is not limited thereto. By setting the aspect ratio of the opening of the ejection port between the major axis and the minor axis at 1 or more, ink flows smoothly and the ejection port can be prevented from being clogged with ink.

It is preferable that the ejection electrode have a shape in which a part on the upstream side in the ink flow direction be removed as in this embodiment. Thus, an electric field which prevents colorant particles from flowing into the ejection port from the upstream side in the ink flow direction is not formed, whereby the colorant particles can be effectively supplied to the ejection port. In addition, since a part of the ejection electrode is disposed on the downstream side from the ejection port in the ink flow direction, an electric field is formed in such a direction that colorant particles having flowed into the ejection port is kept at the ejection port. Accordingly, by forming the ejection electrode into a shape in which a part on the upstream side from the ejection port in the ink flow direction is removed, it is also possible to enhance the capability of supplying particles to the ejection port.

In the ink jet head 10 shown in FIGS. 1A and 1B, the ejection electrode 18 is exposed to the ink flow path 30 and is hence in contact with the ink Q in the ink flow path 30.

Therefore, when the drive voltage is applied to the ejection electrode 18 that is in contact with the ink Q in the ink flow path 30 (ejection ON), part of electric charges supplied to the ejection electrode 18 is injected into the ink Q, which increases the electric conductivity of the ink Q which is located between the ejection port 28 and the ejection electrode 18. Therefore, in the ink jet head 10 of this embodiment, the ink Q is readily ejected in the form of the ink droplets R (ejection property is enhanced) when the drive voltage is applied to the ejection electrode 18 (ejection ON).

In the present invention, the shape of the ejection port is not limited to the one shown in FIG. 1, and an ejection port substrate with any arbitrary shaped ejection port can be used so long as an opening area of an outer opening is larger than that of an inner opening in the ejection port.

It is preferable that the outer opening of the ejection port and the opening of the shield electrode be formed to have approximately the same shape.

Figure 5A:
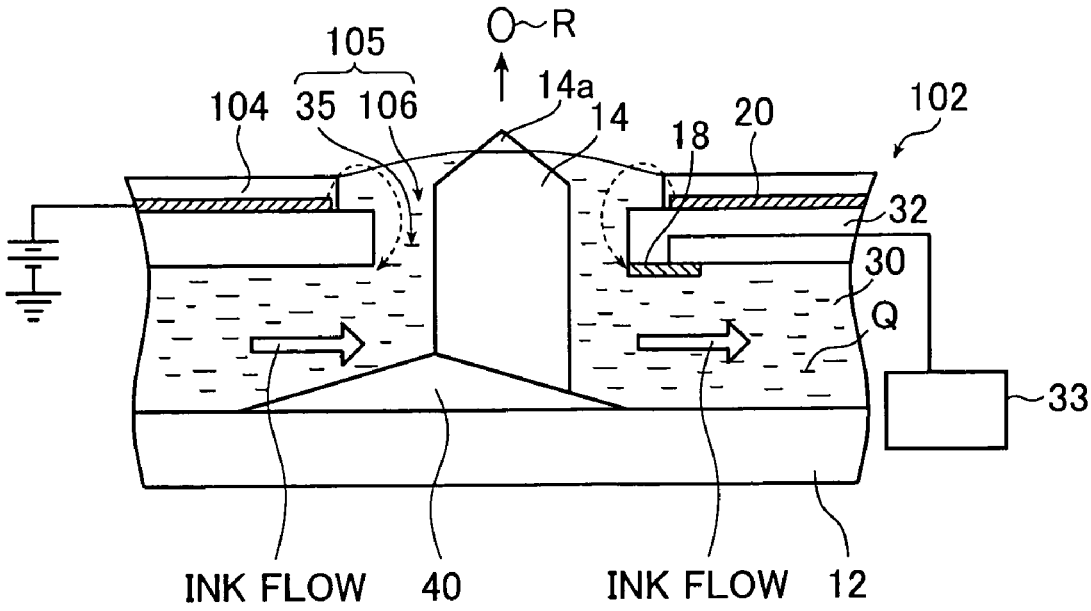
FIGS. 5A and 5B are each a schematic structural view showing another embodiment of an ink jet head of the present invention.

As one example, as shown in FIG. 5A, it is preferable that an opening formed in an insulating layer 104 of an ejection port substrate 102 be formed in approximately the same shape as the opening of the shield electrode 20. Whereby, the opening formed in the insulating layer 104, that is, an outer opening 106 of an ejection port 105, and the opening of the shield electrode 20 can have approximately the same shape.

Figure 5B:
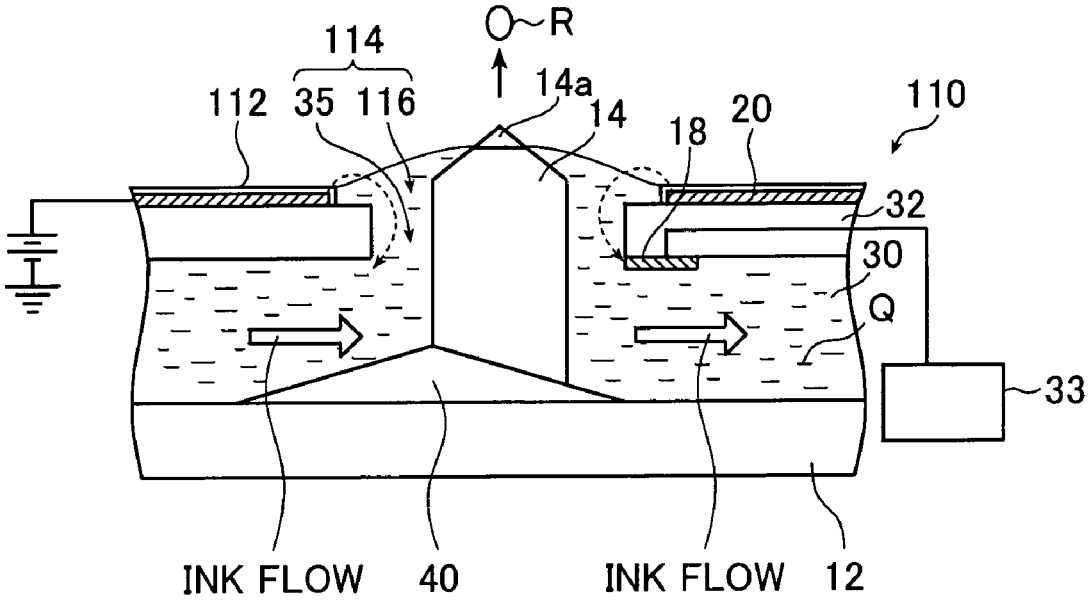

In addition, as shown in FIG. 5B, it is preferable that the insulating layer 112 covering the shield electrode 20 be a thin film. Whereby, the opening of the insulating layer 112 and the opening of the shield electrode 20 formed in the ejection port substrate 110 can have approximately the same shape, and the ejection port substrate 110 can be thin in the thickness direction thereof. With this structure, the outer opening 116 of the ejection port 114 and the opening of the shield electrode can have approximately the same shape.

Figure 6:
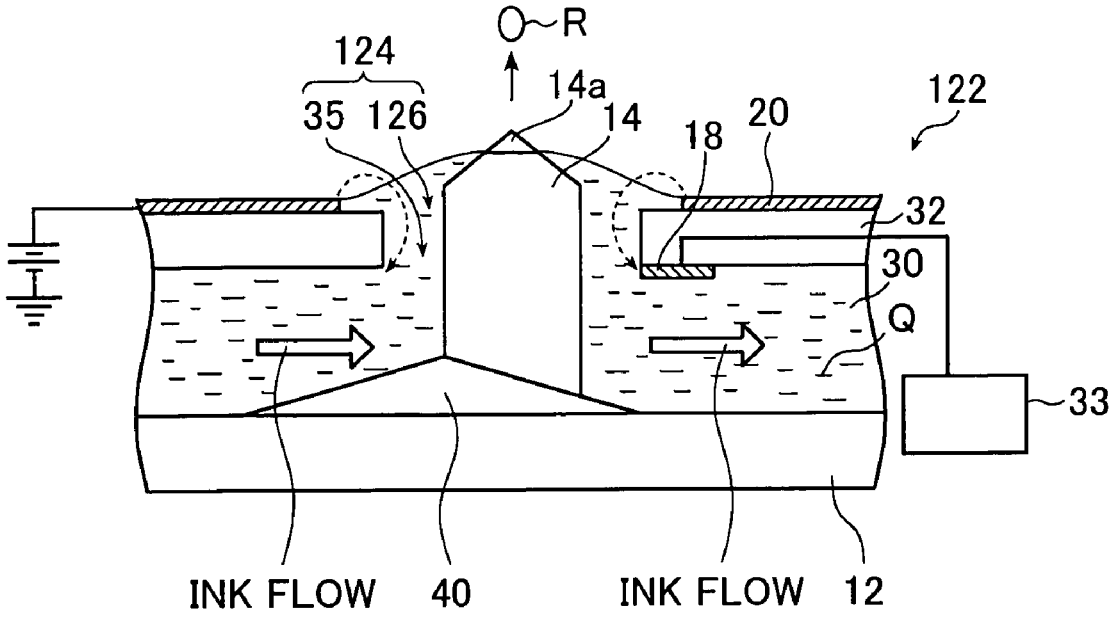
FIG. 6 is a schematic structural view showing still another embodiment of an ink jet head of the present invention.

In FIGS. 1A to 5B, the through hole extending through the insulating substrate is formed as the inner opening, and the through hole extending through the insulating layer is formed as the outer opening. However, as shown in FIG. 6, another structure is also possible in which only the guard substrate 20 is laminated on the insulating substrate 32 without providing an insulating layer in the ejection port substrate 122, an opening of the shield electrode 20 is used as an outer opening 126, and an ejection port 124 is formed of the outer opening 126 and the inner opening 35 extending through the insulating substrate 32. That is, a meniscus may be formed at the opening of the shield electrode 20 having an opening area larger than that of the inner opening 35.

As shown in FIGS. 5A, 5B and 6, by forming the outer opening and the opening of the shield electrode in approximately the same shape, or by using the opening of the shield electrode as the outer opening, a meniscus is formed in the vicinity of the shield electrode. Thus, the force for holding a meniscus (force for pinning a meniscus) at the ejection port by the electric field formed between the shield electrode and the ejection electrode can act in an arrow direction shown in dotted lines in FIGS. 5A, 5B and 6, to form a meniscus more stably. Consequently, it becomes possible to control the ejection of ink droplets more stably, making it possible to draw a high quality image.

Figure 7:
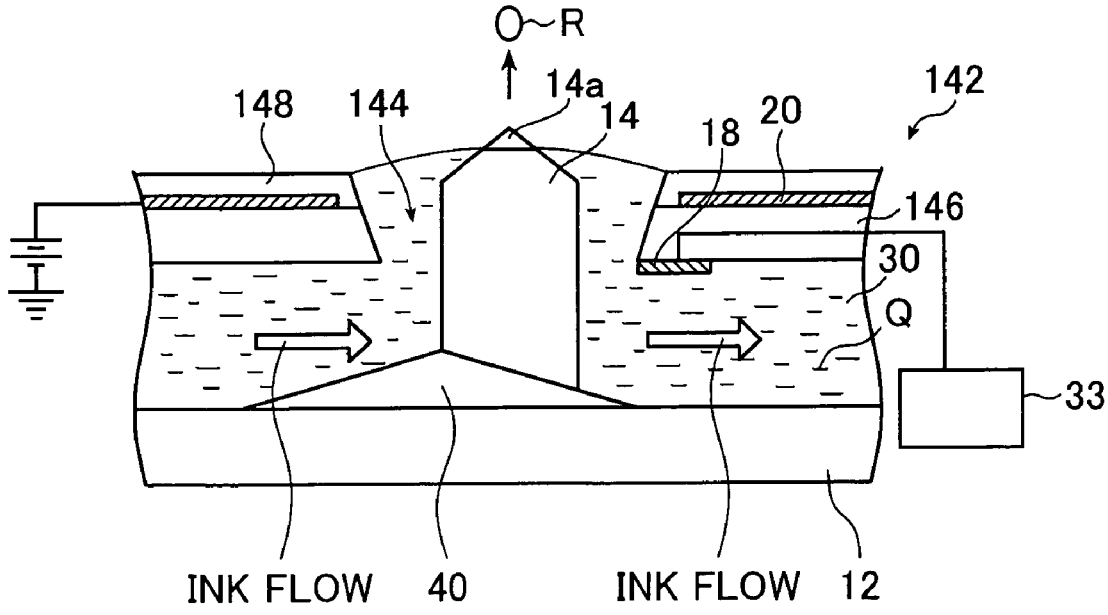
FIG. 7 is a schematic structural view showing yet another embodiment of an ink jet head of the present invention.

In any of the above embodiments, the ejection port has a shape formed by the inner opening whose inner wall surface formed is parallel to the thickness direction of the ejection port substrate, and the outer opening which has the opening area different from that of the inner opening and whose inner wall surface formed is parallel to the thickness direction of the ejection port substrate. In other words, the inner wall of the ejection port has a stepped shape. However, the present invention is not limited thereto, and as shown in FIG. 7, the inner wall of an ejection port 144 formed to extend through an insulating substrate 146 and an insulating layer 148 of an ejection port substrate 142 may be inclined at a predetermined angle with respect to the thickness direction of the ejection port substrate 142. That is, the inner wall of the ejection port 144, i.e., the inner opening and the outer opening, may be formed in a tapered shape, so that the opening area of the outer opening is larger than that of the inner opening.

Figure 8A:
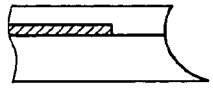
FIGS. 8A to 8D are each a schematic view showing an example of a shape of an inner wall of the ejection port.
Figure 8B:
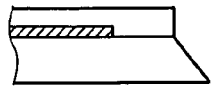
Figure 8C:
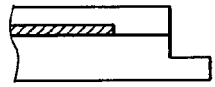
Figure 8D:
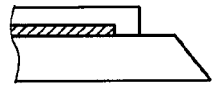

Further, the shape of the inner wall of the ejection port is not limited to a stepped shape or a tapered shape, and various shapes may be adopted for the inner wall so long as the outer opening (opening on the recording medium side) is larger than the inner opening (opening on the ink flow path side) of the ejection port. For example, the inner wall (wall surface) of the ejection port may have a curved surface shape with the cross section in the thickness direction of the ejection port substrate having a curved shape as shown in FIG. 8A, a shape which is a combination of a tapered shape and a cylindrical shape as shown in FIG. 8B, or a shape obtained by forming a step in the insulating substrate as shown in FIG. 8C. Further, as shown in FIG. 8D, the inner wall of the ejection port may have a shape which is a combination of the above described various shapes such as a combination of the stepped shape and the tapered shape.

As shown in FIG. 8A, it is preferable that the angle formed by the upper surface of the ejection port substrate and the inner wall of the ejection port be an acute angle. Whereby, the meniscus holding property at the ejection port is enhanced, and ejection of ink droplets can be performed more stably.

Figure 9:
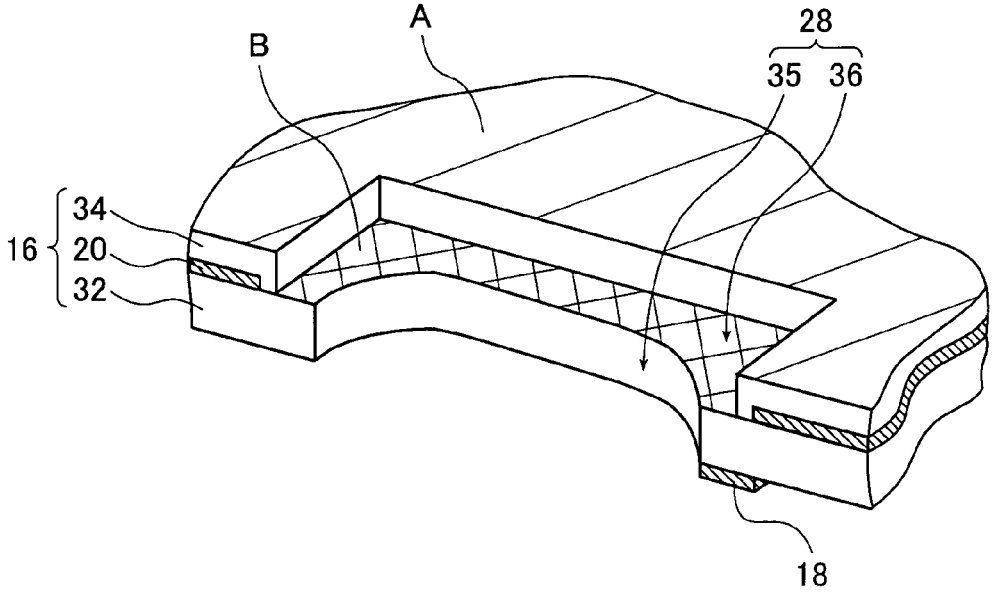
FIG. 9 is an enlarged schematic view showing the vicinity of the ejection port of the ejection port substrate.

As shown in FIG. 9, it is preferable that the surface of the ejection port substrate 16 which is on the recording medium P side and outside the outer opening 36 (area A in FIG. 9), that is, the periphery of the ejection port 28, be subjected to ink repellent treatment. By subjecting the surface of the ejection port substrate 16 which is on the recording medium P side and outside the outer opening 36 to ink repellent treatment, the meniscus holding property at the end portion of the outer opening 36 on the recording medium P side is enhanced, making it possible to stably form a meniscus. Whereby, it becomes possible to eject ink droplets more stably and prevent ink from leaking from the outer opening. Ink repellency means water repellency in the case of water-based ink, and means oil repellency in the case of oil-based ink.

It is preferable that the surface of the ejection port substrate 16 which is on the recording medium P side and is surrounded by the side wall of the inside the outer opening 36, that is, the surface on the recording medium P side of the insulating substrate 32 exposed to the ejection port (area B in FIG. 9) be subjected to ink affinity treatment. By subjecting the surface of the ejection port substrate 16 which is on the recording medium P side and is surrounded by the side wall of the outer opening 36 to ink receptive treatment, the meniscus holding property at the end portion of the outer opening 36 on the recording medium P side is enhanced, making it possible to stably form a meniscus. Whereby, it becomes possible to eject ink droplets more stably and prevent ink from leaking from the outer opening.

As above, a part of the ejection port substrate located outside the position at which the surface of a meniscus contacts the ejection port substrate has ink repellency, and a part of the ejection port substrate located inside the position at which the surface of a meniscus contacts the ejection port substrate has ink receptivity, so that the meniscus holding property is enhanced, making it possible to stably form a meniscus.

Figure 10:
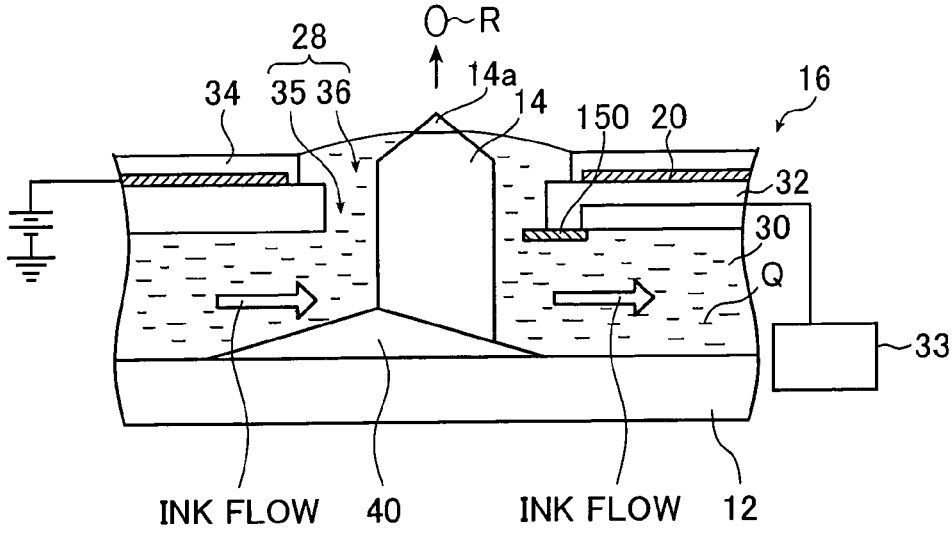
FIG. 10 is a schematic structural view showing still yet another embodiment of an ink jet head of the present invention.
Figure 12:
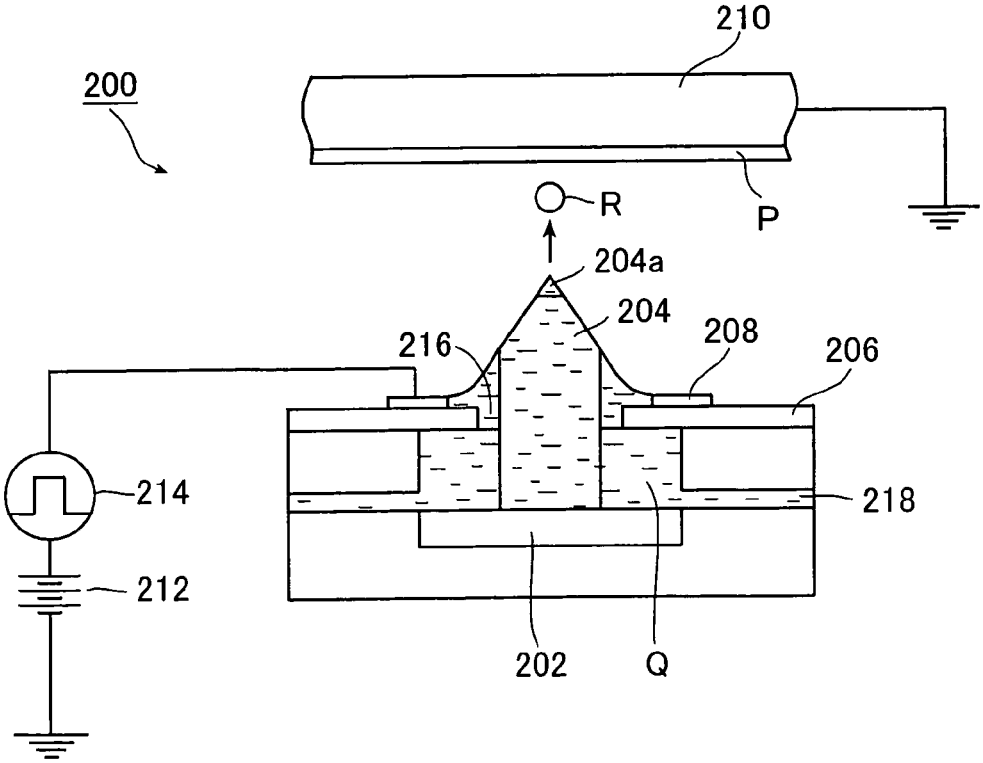
FIG.12 PRIOR ART
FIG. 12 is a schematic view of an example of a conventional ink jet head.

For example, as shown in FIG. 10, a part of an ejection electrode 150 may project into the ejection port 28 so as to close a part of the ejection port 28.

A part of the ejection port 28 is closed by the ejection electrode 150, so that the ink flow path resistance at the ejection port 28 can be increased, thereby enabling the ink ejection cutoff property to be enhanced.

Further, by projecting a part of the ejection electrode into the ejection port 28, the electric field formed in the ejection port 28 becomes stronger. Thus, the ink particles supplying property to the ejection port 28 is enhanced, which makes it possible to preferably concentrate ink at the ejection port 28, thereby enabling further enhancement of the ejection responsivity.

In FIG. 10. the ejection electrode is disposed on the lower surface of the insulating substrate, however, the method of providing the ejection electrode is not specifically limited. The ejection electrode may be provided in a state where a part thereof is buried (embedded) in the insulating substrate, or the ejection electrode may be fixed on or attached to the inner wall which forms the ejection port.

In the case of providing the ejection electrode in the state where a part thereof projects into the ejection port, in view of enhancing the ink ejection cutoff property, it is preferable to provide the ejection electrode so that the ejection electrode is in contact with the surface of the insulating substrate on the ink flow path side as shown in FIG. 10 or the surface of the ejection electrode on the ink flow path side is flush with the surface of the insulating substrate on the ink flow path side. However, it is not limited thereto. It is possible to enhance the ink ejection cutoff property and the ejection responsivity so long as the surface of the ejection electrode on the recording medium side is positioned on the ink flow path side from the surface of the ejection port substrate on the recording medium side in a thickness direction of the ejection port substrate.

The ink used in the ink jet head 10 will be described.

The ink Q is obtained by dispersing colorant particles in a carrier liquid. The carrier liquid is preferably a dielectric liquid (non-aqueous solvent) having a high electrical resistivity (equal to or larger than $10^9$ Ω·cm, and preferably equal to or larger than $10^{10}$ Ω·cm). If the electrical resistance of the carrier liquid is low, the concentration of the colorant particles does not occur since the carrier liquid receives the injection of electric charges and is charged due to a drive voltage applied to the ejection electrodes. In addition, since there is also anxiety that the carrier liquid having a low electrical resistance causes the electrical conduction between adjacent ejection electrodes, the carrier liquid having a low electrical resistance is unsuitable for the present invention.

The relative permittivity of the dielectric liquid used as the carrier liquid is preferably equal to or smaller than 5, more preferably equal to or smaller than 4, and much more preferably equal to or smaller than 3.5. Such a range is selected for the relative permittivity, whereby an electric field effectively acts on the colorant particles contained in the carrier liquid to facilitate the electrophoresis of the colorant particles.

Note that the upper limit of the specific electrical resistance of the carrier liquid is desirably about $10^{16}$ Ω·cm, and the lower limit of the relative permittivity is desirably about 1.9. The reason why the electrical resistance of the carrier liquid preferably falls within the above-mentioned range is that if the electrical resistance becomes low, then the ejection of ink under a low electric field becomes worse. Also, the reason why the relative permittivity preferably falls within the above-mentioned range is that if the relative permittivity becomes high, then an electric field is relaxed due to the polarization of a solvent, and as a result the color of dots formed under this condition becomes light, or the bleeding occurs.

Preferred examples of the dielectric liquid used as the carrier liquid include straight-chain or branched aliphatic hydrocarbons, alicyclic hydrocarbons, aromatic hydrocarbons, and the same hydrocarbons substituted with halogens. Specific examples thereof include hexane, heptane, octane, isooctane, decane, isodecane, decalin, nonane, dodecane, isododecane, cyclohexane, cyclooctane, cyclodecane, benzene, toluene, xylene, mesitylene, Isopar C, Isopar E, Isopar G, Isopar H, Isopar L, Isopar M (Isopar: a trade name of EXXON Corporation), Shellsol 70, Shellsol 71 (Shellsol: a trade name of Shell Oil Company), AMSCO OMS, AMSCO 460 Solvent (AMSCO: a trade name of Spirits Co., Ltd.), a silicone oil (such as KF-96L, available from Shin-Etsu Chemical Co., Ltd.). The dielectric liquid may be used singly or as a mixture of two or more thereof.

For such colorant particles dispersed in the carrier liquid, colorants themselves may be dispersed as the colorant particles into the carrier liquid, but dispersion resin particles are preferably contained for enhancement of the fixing property. In the case where the dispersion resin particles are contained in the carrier liquid, in general, there is adopted a method in which pigments are covered with the resin material of the dispersion resin particles to obtain particles covered with the resin, or the dispersion resin particles are colored with dyes to obtain the colored particles.

As the colorants, pigments and dyes conventionally used in ink compositions for ink jet recording, (oily) ink compositions for printing, or liquid developers for electrostatic photography may be used.

Pigments used as colorants may be inorganic pigments or organic pigments commonly employed in the field of printing technology. Specific examples thereof include but are not particularly limited to known pigments such as carbon black, cadmium red, molybdenum red, chrome yellow, cadmium yellow, titanium yellow, chromium oxide, viridian, cobalt green, ultramarine blue, Prussian blue, cobalt blue, azo pigments, phthalocyanine pigments, quinacridone pigments, isoindolinone pigments, dioxazine pigments, threne pigments, perylene pigments, perinone pigments, thioindigo pigments, quinophthalone pigments, and metal complex pigments.

Preferred examples of dyes used as colorants include oil-soluble dyes such as azo dyes, metal complex salt dyes, naphthol dyes, anthraquinone dyes, indigo dyes, carbonium dyes, quinoneimine dyes, xanthene dyes, aniline dyes, quinoline dyes, nitro dyes, nitroso dyes, benzoquinone dyes, naphthoquinone dyes, phthalocyanine dyes, and metal phthalocyanine dyes.

Further, examples of the dispersion resin particles include rosins, rosin-modified phenol resin, alkyd resin, a (meth)acryl polymer, polyurethane, polyester, polyamide, polyethylene, polybutadiene, polystyrene, polyvinyl acetate, acetal-modified polyvinyl alcohol, and polycarbonate.

Of those, from the viewpoint of ease for particle formation, a polymer having a weight average molecular weight in a range of 2,000 to 1,000,000 and a polydispersity (weight average molecular weight/number average molecular weight) in a range of 1.0 to 5.0 is preferred. Moreover, from the viewpoint of ease for the fixation, a polymer in which one of a softening point, a glass transition point, and a melting point is in a range of 40° C. to 120° C. is preferred.

In the ink Q, the content of colorant particles (total content of colorant particles and dispersion resin particles) preferably falls within a range of 0.5 to 30 wt % for the overall ink, more preferably falls within a range of 1.5 to 25 wt %, and much more preferably falls within a range of 3 to 20 wt %. If the content of the colorant particles decreases, the following problems become easy to arise. The density of a printed image is insufficient, the affinity between the ink Q and the surface of the recording medium P becomes difficult to obtain to prevent an image firmly stuck to the surface of the recording medium P from being obtained, and so forth. On the other hand, if the content of the colorant particles increases, problems occur in that the uniform dispersion liquid becomes difficult to obtain, the clogging of the ink Q is easy to occur in the ink jet head or the like to make it difficult to obtain the consistent ink ejection, and so forth.

In addition, the average particle diameter of the colorant particles dispersed in the carrier liquid preferably falls within a range of 0.1 to 5 μm, more preferably falls within a range of 0.2 to 1.5 μm, and much more preferably falls within a range of 0.4 to 1.0 μm. Those particle diameters are measured with CAPA-500 (a trade name of a measuring apparatus manufactured by HORIBA Ltd.).

After the colorant particles and optionally a dispersing agent are dispersed in the carrier liquid, a charging control agent is added to the resultant carrier liquid to charge the colorant particles, and the charged colorant particles are dispersed in the resultant liquid to thereby produce the ink Q. Note that in dispersing the colorant particles in the carrier liquid, a dispersion medium may be added if necessary.

As the charging control agent, for example, various ones used in the electrophotographic liquid developer can be utilized. In addition, it is also possible to utilize various charging control agents described in "DEVELOPMENT AND PRACTICAL APPLICATION OF RECENT ELECTRONIC PHOTOGRAPH DEVELOPING SYSTEM AND TONER MATERIALS", pp. 139 to 148; "ELECTROPHOTOGRAPHY-BASES AND APPLICATIONS", edited by THE IMAGING SOCIETY OF JAPAN, and published by CORONA PUBLISHING CO. LTD., pp. 497 to 505, 1988; and "ELECTRONIC PHOTOGRAPHY" by Yuji Harasaki, 16(No. 2), p. 44, 1977.

Note that the colorant particles may be positively or negatively charged as long as the charged colorant particles are identical in polarity to the drive voltages applied to ejection electrodes.

In addition, the charging amount of the colorant particles is preferably in a range of 5 to 200 μC/g, more preferably in a range of 10 to 150 μC/g, and much more preferably in a range of 15 to 100 μC/g.

In addition, the electrical resistance of the dielectric solvent may be changed by adding the charging control agent in some cases. Thus, the distribution factor P defined below is preferably equal to or larger than 50%, more preferably equal to or larger than 60%, and much more preferably equal to or larger than 70%.

$$P=100\times(\sigma 1-\sigma 2)/\sigma 1$$

where σ1 is an electric conductivity of the ink Q, and σ2 is an electric conductivity of a supernatant liquid which is obtained by inspecting the ink Q with a centrifugal separator. Those electric conductivities were measured by using an LCR meter (AG-4311 manufactured by ANDO ELECTRIC CO., LTD.) and an electrode for liquid (LP-05 manufactured by KAWAGUCHI ELECTRIC WORKS, CO., LTD.) under a condition of an applied voltage of 5 V and a frequency of 1 kHz: In addition, the centrifugation was carried out for 30 minutes under a condition of a rotational speed of 14,500 rpm and a temperature of 23° C. using a miniature high speed cooling centrifugal machine (SRX-201 manufactured by TOMY SEIKO CO., LTD.).

The ink Q as described above is used, which results in that the colorant particles are likely to migrate and hence the colorant particles are easily concentrated.

The electric conductivity of the ink Q is preferably in a range of 100 to 3,000 pS/cm, more preferably in a range of 150 to 2,500 pS/cm, and much more preferably in a range of 200 to 2,000 pS/cm. The range of the electric conductivity as described above is set, resulting in that the applied voltages to the ejection electrodes are not excessively high, and also there is no anxiety to cause the electrical conduction between adjacent ejection electrodes.

In addition, the surface tension of the ink Q is preferably in a range of 15 to 50 mN/m, more preferably in a range of 15.5 to 45 mN/m, and much more preferably in a range of 16 to 40 mN/m. The surface tension is set in this range, resulting in that the applied voltages to the ejection electrodes are not excessively high, and also ink does not leak or spread to the periphery of the head to contaminate the head.

Moreover, the viscosity of the ink Q is preferably in a range of 0.5 to 5 mPa·sec, more preferably in a range of 0.6 to 3.0 mPa·sec, and much more preferably in a range of 0.7 to 2.0 mPa·sec.

The ink Q can be prepared for example by dispersing colorant particles into a carrier liquid to form particles and adding a charging control agent to a dispersion medium to allow the colorant particles to be charged. The following methods are given as the specific methods.

(1) A method including: previously mixing (kneading) a colorant and optionally dispersion resin particles; dispersing the resultant mixture into a carrier liquid using a dispersing agent when necessary; and adding a charging control agent thereto.

(2) A method including: adding a colorant and optionally dispersion resin particles and a dispersing agent into a carrier liquid at the same time for dispersion; and adding a charging control agent thereto.

(3) A method including adding a colorant and a charging control agent and optionally a dispersion resin particles and a dispersing agent into a carrier liquid at the same time for dispersion.

Figure 11A:
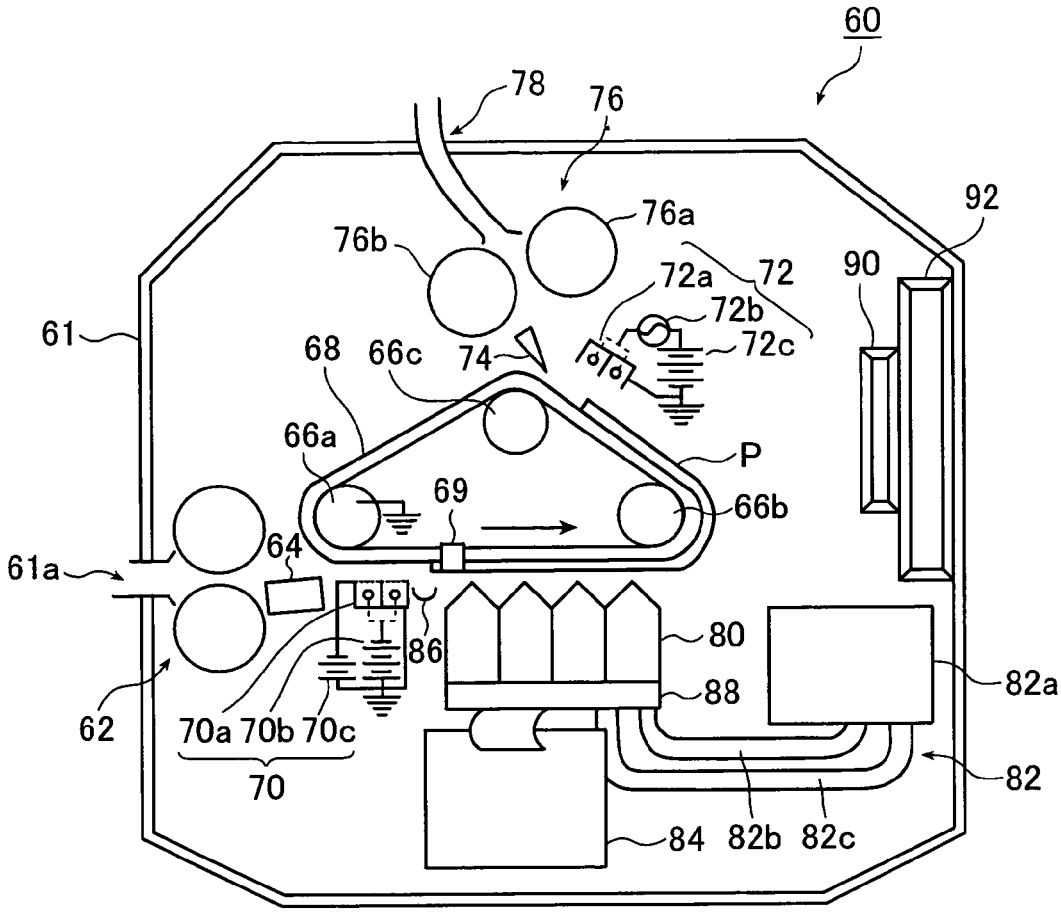
FIGS. 11A and 11B are conceptual diagrams of an embodiment of an ink jet recording apparatus of the present invention.

FIG. 11A is a conceptual diagram of an embodiment of an ink jet recording apparatus of the present invention which utilizes the ink jet head of the present invention.

An ink jet recording apparatus 60 (hereinafter, referred to as a printer 60) shown in FIG. 11A is an apparatus for performing four-color one-side printing on the recording medium P. The printer 60 includes conveyor means for the recording medium P, image recording means, and solvent collecting means, all of which are accommodated in a casing 61.

The conveyor means is means for relatively moving the recording medium with respect to the ink jet head, and includes a feed roller pair 62, a guide 64, rollers 66 (66*a*, 66*b*, and 66*c*), a conveyor belt 68, conveyor belt position detecting means 69, electrostatic attraction means 70, electrostatic elimination means 72, separation means 74, fixation/conveyance means 76, and a guide 78. The image recording means includes a head unit 80, an ink circulation system 82, a head driver 84 and recording medium position detecting means 86.

The solvent collecting means includes a discharge fan 90, and a solvent collecting device 92.

In the conveyor means for the recording medium P, the feed roller pair 62 is a conveyance roller pair disposed in the vicinity of a feeding port 61*a* provided in a side surface of the casing 61. The feed roller pair 62 feeds the recording medium P fed from a paper cassette (not shown) to the conveyor belt 68 (a portion supported by the roller 66*a* in FIG. 11A). The guide 64 is disposed between the feed roller pair 62 and the roller 66*a* for supporting the conveyor belt 68 and guides the recording medium P fed by the feed roller pair 62 to the conveyor belt 68.

Foreign matter removal means for removing foreign matter such as dust or paper powder adhered to the recording medium P is preferably disposed in the vicinity of the feed roller pair 62.

As the foreign matter removal means, one or more of known methods including non-contact removal methods such as suction removal, blowing removal and electrostatic removal, and contact removal methods such as removal using a blush, a roller, etc., may be used in combination. It is also possible that the feed roller pair 62 is composed of a slightly adhesive roller, a cleaner is prepared for the feed roller pair 62, and foreign matter such as dust or paper powder is removed when the feed roller pair 62 feeds the recording medium P.

The conveyor belt 68 is an endless belt stretched around the three rollers 66 (66*a*, 66*b*, and 66*c*). At least one of the rollers 66*a*, 66*b*, and 66*c* is connected to a drive source (not shown) to rotate the conveyor belt 68.

At the time of image recording by the head unit 80, the conveyor belt 68 functions as scanning conveyor means for the recording medium P and also as a platen for holding the recording medium P. After the end of image recording, the conveyor belt 68 further conveys the recording medium P to the fixation/conveyance means 76. Therefore, the conveyor belt 68 is preferably made of a material which is excellent in dimension stability and has durability. For example, the conveyor belt 68 is made of a metal, a polyimide resin, a fluororesin, another resin, or a complex thereof.

In the illustrated embodiment, the recording medium P is held on the conveyor belt 68 under electrostatic attraction. In correspondence with this, the conveyor belt 68 has insulating properties on a side on which the recording medium P is held (front face), and conductive properties on the other side on which the belt 68 contacts the rollers 66 (rear face). Further, in the illustrated embodiment, the roller 66*a* is a conductive roller, and the rear face of the conveyor belt 68 is grounded via the roller 66*a*.

In other words, when the conveyor belt 68 holds the recording medium P, the conveyor belt 68 also functions as the counter electrode 24 including the electrode substrate 24*a* and the insulating sheet 24*b* shown in FIG. 1A.

A belt having a metal layer and an insulating material layer manufactured by a variety of methods, such as a metal belt coated with any of the above described resin materials, for example, fluororesin on the front face, a belt obtained by bonding a resin sheet to a metal belt with an adhesive or the like, and a belt obtained by vapor-depositing a metal on the rear face of a belt made of the above-mentioned resin, may be used as the conveyor belt 68.

The conveyor belt 68 preferably has the flat front face contacting the recording medium P, whereby satisfactory attraction properties of the recording medium P can be obtained.

Meandering of the conveyor belt 68 is preferably suppressed by a known method. An example of a meandering suppression method is that the roller 66*c* is composed of a tension roller, a shaft of the roller 66*c* is inclined with respect to the shafts of the rollers 66*a* and 66*b* in response to an output of the conveyor belt position detecting means 69, that is, a position of the conveyor belt 68 detected in a width direction, thereby changing a tension at both ends of the conveyor belt in the width direction to suppress the meandering. The rollers 66 may have a taper shape, a crown shape, or another shape to suppress the meandering.

The conveyor belt position detecting means 69 suppresses the meandering of the conveyor belt etc. in the above manner and detects the position of the conveyor belt 68 in the width direction to regulate the recording medium P to situate at a predetermined position in the scanning/conveyance direction at the time of image recording. Known detecting means such as a photo sensor may be used.

The electrostatic attraction means 70 charges the recording medium P to a predetermined bias voltage with respect to the head unit 80 (above described ink jet head), and charges the recording medium P to have a predetermined potential such that the recording medium P is attracted to and held on the conveyor belt 68 under electrostatic force.

In the illustrated embodiment, the electrostatic attraction means 70 includes a scorotron charger 70*a* for charging the recording medium P, a high voltage power source 70*b* connected to the scorotron charger 70*a*, and a bias voltage source 77*c*. The corona wire of the scorotron charger 70*a* is connected to the terminal of the high voltage power source 70*b* on the negative side, and the terminal of the high voltage power source 70*b* on the positive side and the metallic shield case of the scorotron charger 70*a* are grounded. The terminal of the bias voltage source 70*c* on the negative side is connected to the grid electrode of the scorotron charger 70*a*, and the terminal of the bias voltage source 70*c* on the positive side is grounded.

While being conveyed by the feed roller pair 62 and the conveyor belt 68, the recording medium P is charged to a negative bias voltage by the scorotron charger 70*a* connected to the high voltage power source 70*b* and electrostatically attracted to the insulating layer of the conveyor belt 68.

Note that the conveying speed of the conveyor belt 68 when charging the recording medium P may be in a range where the charging is performed with stability, so the speed may be the same as, or different from, the conveying speed at the time of image recording. Also, the electrostatic attraction means may act on the same recording medium P several times by circulating the recording medium P several times on the conveyor belt 68 for uniform charging.

In the illustrated embodiment, the electrostatic attraction and the charging for the recording medium P are performed in the electrostatic attraction means 70, but the electrostatic attraction means and the charging means may be provided separately.

The electrostatic attraction means is not limited to the scorotron charger 70*a* of the illustrated example, a corotron charger, a solid-state charger, an electrostatic discharge needle and various means and methods can be employed. As will be described in detail later, another method may be adapted in which at least one of the rollers 66 is composed of a conductive roller or a conductive platen is disposed on the rear side of the conveyor belt 68 in a recording position for the recording medium P (side opposite to the recording medium P), and the conductive roller or the conductive platen is connected to the negative high voltage power source, thereby forming the electrostatic attraction means 70. Alternatively, it is also possible that the conveyor belt 68 is composed of an insulating belt and the conductive roller is grounded to connect the conductive platen to the negative high voltage power source.

The conveyor belt 68 conveys the recording medium P charged by the electrostatic attraction means 70 to the position where the head unit 80 to be described later is located.

The head unit 80 uses the ink jet head of the present invention to eject ink droplets in accordance with image data to thereby record an image on the recording medium P. The ink jet head of the present invention uses a charge potential of the recording medium P for the bias voltage and applies a drive voltage to the ejection electrodes 18, whereby the drive voltage is superposed on the bias voltage and the ink droplets R are ejected to record an image on the recording medium P. At this time, the conveyor belt 68 is provided with heating means to increase the temperature of the recording medium P, thus promoting fixation of the ink droplets R on the recording medium P and further suppressing ink bleeding, which leads to improvement in image quality.

Image recording using the head unit 80 and the like will be described in detail below.

The recording medium P on which the image is formed is discharged by the electrostatic elimination means 72 and separated from the conveyor belt 68 by the separation means 74 and thereafter, conveyed to the fixation/conveyance means 76.

In the illustrated embodiment, the electrostatic elimination means 72 is a so-called AC corotron charger, which includes a corotron charger 72*a*, an AC voltage source 72*b*, and a high voltage power source 72*c*. The corona wire of the corotron charger 72*a* is connected to the high voltage power source 72*c* through the AC voltage source 72*b*, and the other end of the high voltage power source 70*b* and the metallic shield case of the corotron charger 72*a* are grounded. In addition thereto, various means and methods, for example, a scorotron charger, a solid-state charger, and an electrostatic discharge needle can be used for electrostatic elimination means. Also, as in the electrostatic attraction means 70 described above, a structure using a conductive roller or a conductive platen can also be preferably utilized.

A known technique using a separation blade, a counter-rotating roller, an air knife or the like is applicable to the separation means 74.

The recording medium P separated from the conveyor belt 68 is sent to the fixation/conveyance means 76 where the image formed by means of the ink jet recording is fixed. A pair of rollers composed of a heat roller 76*a* and a conveying roller 76*b* is used as the fixation/conveyance means 76 to heat and fix a recorded image while nipping and conveying the recording medium P.

The recording medium P on which the image is fixed is guided by the guide 78 and delivered to a delivered paper tray (not shown).

In addition to the heat roll fixation described above, examples of the heat fixation means include irradiation with infrared rays or using a halogen lamp or a xenon flash lamp, and general heat fixation such as hot air fixation using a heater. Further, in the fixation/conveyance means 76, it is also possible that the heating means is used only for heating, and the conveyance means and the heat fixation means are provided separately.

It should be noted that in the case of heat fixation, when a sheet of coated paper or laminated paper is used as the recording medium P, there is a possibility of causing a phenomenon called "blister" in which irregularities are formed on the sheet surface since moisture inside the sheet abruptly evaporates due to rapid temperature increase. To avoid this, it is preferable that a plurality of fixing devices be arranged, and at least one of power supply to the respective fixing devices and a distance from the respective fixing devices to the recording medium P be changed such that the temperature of the recording medium P gradually increases.

The printer 60 is preferably constructed such that no components will contact the image recording surface of the recording medium P at least during a time from the image recording with the head unit 80 until the completion of fixation with the fixation/conveyance means 76.

Further, the movement speed of the recording medium P at the time of fixation with the fixation/conveyance means 76 is not particularly limited, and may be the same as, or different from, the speed of the recording medium conveyed by the conveyor belt 68 at the time of image formation. When the movement speed is different from the conveying speed at the time of image formation, it is also preferable to provide a speed buffer for the recording medium P immediately before the fixation/conveyance means 76.

Image recording using the printer 60 will be described in detail below.

As described above, the image recording means of the printer 60 uses the ink jet head of the present invention, and includes the head unit 80 for ejecting ink, the ink circulation system 82 that supplies the ink Q to the head unit 80 and recovers the ink Q from the head unit 80, the head driver 84 that drives the head unit 80 based on an output image signal from a not-shown external apparatus such as a computer or a raster image processor (RIP), and the recording medium position detecting means 86 for detecting the recording medium P in order to determine an image recording position on the recording medium P.

Figure 11B:
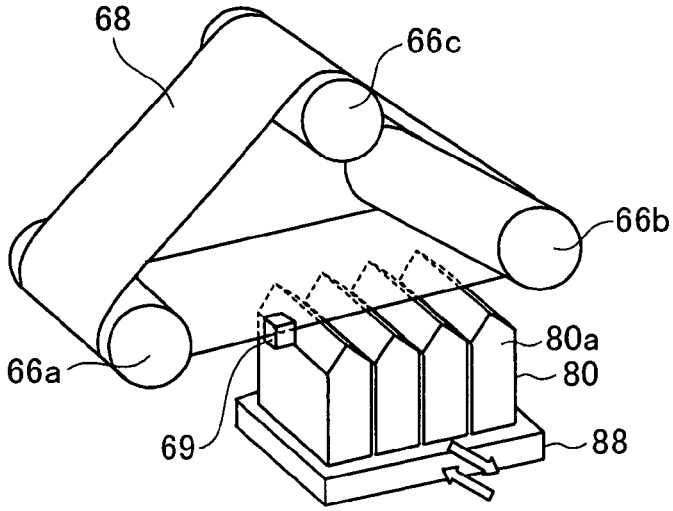

FIG. 11B is a schematic perspective view showing the head unit 80 and the conveying means (moving means) for the recording medium P on the periphery thereof.

The head unit 80 includes four ink jet heads 80*a* for four colors of cyan (C), magenta (M), yellow (Y), and black (K) for recording a full-color image, and records an image on the recording medium P conveyed by the conveyor belt 68 at a predetermined speed by ejecting the ink Q supplied by the ink circulation system 82 as the ink droplets R in accordance with signals from the head driver 84 to which image data was supplied.

The ink jet head 80*a* has the same configuration as the above ink jet head 10.

The ink jet heads 80*a* for the respective colors are arranged along a conveying direction of the conveyor belt 68.

In the illustrated embodiment, each of the ink jet heads 80*a* is a line head including ejection ports 28 disposed in the entire area in the width direction of the recording medium P. The ink jet head 80*a* is preferably a multi-channel head as shown in FIG. 2, which has multiple nozzle lines, arranged in a staggered shape.

Therefore, in the illustrated embodiment, while the recording medium P is held on the conveyor belt 68, the recording medium P is conveyed to pass over the head unit 80 once. In other words, scanning and conveyance are performed only once for the head unit 80. Then, an image is formed on the entire surface of the recording medium P. Therefore, image recording (drawing) at a higher speed is possible compared to serial scanning of the ejection head.

Note that the ink jet head of the present invention is also applicable to a so-called serial head (shuttle type head), and therefore the printer 60 may take this configuration.

In this case, the head unit 80 is structured such that a line (which may have a single line or multi channel structure) of the ejection ports 28 for each ink jet head agrees with the conveying direction of the conveyor belt 68, and the head unit 80 is provided with scanning means which scans the head unit 80 in a direction perpendicular to the conveying direction of the recording medium P. Any known scanning means can be used for scanning.

Image recording may be performed as in a usual shuttle type ink jet printer. In accordance with the length of the line of the ejection ports 28, the recording medium P is conveyed intermittently by the conveyor belt 68, and in synchronization with this intermittent conveying, the head unit 80 is scanned when the recording medium is at rest, whereby an image is formed on the entire surface of the recording medium P.

As described above, the image formed by the head unit 80 on the entire surface of the recording medium P is then fixed by the fixation/conveyance means 76 while the recording medium P is nipped and conveyed by the fixation/conveyance means 76.

The head driver 84 receives image data from a system control unit (not shown) that receives image data from an external apparatus and performs various processing on the image data, and drives the head unit 80 based on the image data.

The system control unit color-separates the image data received from the external apparatus such as a computer, an RIP, an image scanner, a magnetic disk apparatus, or an image data transmission apparatus. The system control unit then performs division computation into an appropriate number of pixels and an appropriate number of gradations to generate image data with which the head driver 84 can drive the head unit 80 (ink jet head). Also, the system control unit controls timings of ink ejection by the head unit 80 in accordance with conveyance timings of the recording medium P by the conveyor belt 68. The ejection timings are controlled using an output from the recording medium position detecting means 86 or an output signal from an encoder arranged for the conveyor belt 68 or a drive means of the conveyor belt 68.

The recording medium position detecting means 86 detects the recording medium P being conveyed to a position at which an ink droplet is ejected onto the medium P from the head unit 80, and known detecting means such as photo sensor can be used.

Here, when the number of the ejection portions to be controlled (the number of channels) is large as in the case where a line head is used, the head driver 84 may separate rendering to employ a known method such as resistance matrix type drive method or resistance diode matrix type drive method. Thus, it is possible to reduce the number of ICs used in the head driver 84 and suppress the size of a control circuit while lowering costs.

The ink circulation system 82 allows each ink Q to flow in the ink flow path 30 (see FIG. 1A) of the corresponding ink jet head 80*a* of the head unit 80. The ink circulation system 82 includes: an ink circulation device 82*a* having an ink tank, a pump, a replenishment ink tank (not shown), etc. for each of the ink of the four colors (C, M, Y, K); an ink supply system 82*b* for supplying the ink Q of each color from the ink tank of the ink circulation device 82*a* to the ink flow path 30 of each ink jet head 80*a* of the head unit 80; and an ink recovery system 82*c* for recovering the ink Q from the ink flow path 30 of each ink jet head 80*a* of the head unit 80 into the ink circulation device 82*a*.

An arbitrary system may be used for the ink circulation system 82 as long as this system supplies the ink Q of each color from the ink tank to the head unit 80 through the ink supply system 82*b* and recovers the ink of each color from the head unit 80 to the ink tank through the ink recovery system 82*c* to allow ink circulation.

Each ink tank contains the ink Q of the corresponding color and the ink Q is supplied to the head unit 80 by means of a pump. Ejection of the ink from the head unit 80 lowers the concentration of the ink circulating in the ink circulation system 82. Therefore, it is preferable in the ink circulation system 82 that the ink concentration be detected by an ink concentration detecting device and the ink tank be replenished as appropriate with ink from the replenishment ink tank to keep the ink concentration in a predetermined range.

Moreover, the ink tank is preferably provided with an agitator for suppressing precipitation/aggregation of solid components of the ink and an ink temperature control device for suppressing ink temperature change. The reason thereof is as follows. If the temperature control is not performed, the ink temperature changes due to ambient temperature change or the like. Thus, physical properties of the ink are changed, which causes the dot diameter change. As a result, a high quality image may not be recorded in a consistent manner.

A rotary blade, an ultrasonic transducer, a circulation pump, or the like may be used for the agitator.

Any known method can be used for ink temperature control, as exemplified by a method in which the ink temperature is controlled with the ink temperature control device which includes a heating element or a cooling element such as a heater and Peltier element provided in the head unit 80, the ink tank, an ink supply line or the like, and a temperature sensor like a thermostat. When arranged inside the ink tank, the temperature control device is preferably arranged with the agitator such that temperature distribution is kept constant. Then, the agitator for keeping the concentration distribution in the tank constant may double as the agitator for suppressing the precipitation/aggregation of solid components of the ink.

As described above, the printer 60 includes the solvent collecting means composed of the discharge fan 90 and the solvent collecting device 92. The solvent collecting means collects the carrier liquid evaporated from the ink droplets ejected on the recording medium P from the head unit 80, in particular, the carrier liquid evaporated from the recording medium P at the time of fixing an image formed of the ink droplets.

The discharge fan 90 sucks air inside the casing 61 of the printer 60 to blow the air to the solvent collecting device 92.

The solvent collecting device 92 is provided with a solvent vapor absorber. This solvent vapor absorber absorbs solvent components of gas containing solvent vapor sucked by the discharge fan 90, and exhausts the gas whose solvent has been absorbed and collected, to the outside of the casing 61 of the printer 60. Various active carbons are preferably used as the solvent vapor absorber.

While the electrostatic ink jet recording apparatus for recording a color image using the ink of four colors including C, M, Y, and K has been described, the present invention should not be construed restrictively; the apparatus may be a recording apparatus for a monochrome image or an apparatus for recording an image using an arbitrary number of other colors such as pale color ink and special color ink, for example. In such a case, the head units 80 and the ink circulation systems 82 whose number corresponds to the number of ink colors are used.

Furthermore, in the above embodiments, the ink jet recording apparatus in which the ink droplets R are ejected by positively charging the colorant particles in the ink and charging the recording medium P or the counter electrode on the rear side of the recording medium P to the negative high voltage has been described. However, the present invention is not limited to this. Contrary to the above, the ink jet image recording may be performed by negatively charging the colorant particles in the ink and charging the recording medium or the counter electrode to the positive high voltage. When the charged color particles have the polarity opposite to that in the above-mentioned case, it is sufficient that the applied voltage to the electrostatic attraction means, the counter electrode, the drive electrode of the ink jet head, or the like is changed to have the polarity opposite to that in the above-mentioned case.

As described above, the ink jet head of the present invention is preferably used in the above described electrostatic ink jet recording system, however, it is not limited thereto, and can be used in various ink jet recording systems such as a piezoelectric system and a thermal system.

While the ink jet head and ink jet recording apparatus using the ink jet head according to the present invention have been described in detail above, it should be noted that the invention is by no means limited to the foregoing embodiments, and various improvements and modifications may of course be made without departing from the scope of the invention.

For example, preferably, the ink jet head is provided with the ink guide 14 in view of enhancing stability of a flying direction of ink droplets, the ejection responsivity, stability of a meniscus, and the like, however, the present invention is not limited thereto. The configuration may be such that there is no ink guide provided in the ink jet head.

What is claimed is:

1. An ink jet head for ejecting ink droplets onto a recording medium, comprising:

an ejection port substrate having ejection ports for ejecting said ink droplets and being electrically insulative; and control means that controls ejection of said ink droplets from said ejection ports, wherein each of said ejection ports is a through hole having an outer opening formed in a surface of said ejection port substrate on a side facing said recording medium and an inner opening formed in another surface of said ejection port substrate on a side opposite to said side facing said recording medium, and connecting said outer opening and said inner opening to each other, at least said inner opening has a shape anisotropy, and a first opening area of said outer opening is larger than a second opening area of said inner opening.

2. The ink jet head according to claim 1, wherein an inner wall of an opening formed in said ejection port substrate for each of said ejection ports has a stepped shape.

3. The ink jet head according to claim 1, wherein an inner wall of an opening formed in said ejection port substrate for each of said ejection ports has a tapered shape.

4. The ink jet head according to claim 1, wherein said ejection port substrate includes:

at least one ejection electrode provided so as to surround each of said ejection ports; and a shield electrode provided at a position which is on a recording medium side of said ejection electrode, wherein said control means is said ejection electrode.

5. The ink jet head according to claim 4, wherein an opening is formed in said shield electrode so as to surround each of said ejection ports.

6. The ink jet head according to claim 5, wherein said outer opening and said opening formed in said shield electrode are approximately identical in shape.

7. The ink jet head according to claim 5, wherein said opening formed in said shield electrode is said outer opening.

8. The ink jet head according to claim 1, further comprising:

a head substrate which is spaced apart from said ejection port substrate by a predetermined distance so as to form an ink flow path between said head substrate and said ejection port substrate, wherein said inner opening has the shape anisotropy with a long side thereof extending in a direction in which ink flows in said ink flow path.

9. The ink jet head according to claim 8, further comprising:

ink guides, each of which is disposed on an ejection port substrate side of the head substrate so as to correspond to each of said ejection ports, and extends through each of said ejection ports so that a tip end portion each of said ink guides projects above from said surface of said ejection port substrate on said side facing said recording medium.

10. The ink jet head according to claim 8, further comprising:

ink guide dikes on a surface of said head substrate on an ink flow path side, each of said ink guide dikes forming an ink flow that passes from an upstream side in an ink flow direction toward each of said ejection ports.

11. The ink jet head according to claim 8, wherein said inner opening has a noncircular shape elongated in the direction parallel to an ink flow direction in which ink flows in said ink flow path.

12. The ink jet head according to claim 8, wherein said ink flow path between said head substrate and said ejection port substrate is straight at each of said ejection ports.

13. The ink jet head according to claim 1, wherein said inner opening has a noncircular shape elongated in a direction parallel to an ink flow direction.

14. The ink jet head according to claim 13, wherein said noncircular shape is a shape in which an aspect ratio (L/D) between a length L in the ink flow direction and a length D in a direction orthogonal to the ink flow direction is more than 1.

15. The ink jet head according to claim 14, wherein said noncircular shape is a shape with a longer side extending in the ink flow direction and having the length L, and a shorter side extending in the direction orthogonal to the ink flow direction and having the length D being shorter than the length L.

16. The ink jet head according to claim 1, wherein said inner opening and said outer opening have the noncircular shape elongated in the direction parallel to the ink flow direction.

17. An ink jet head for ejecting ink droplets onto a recording medium, comprising:

an ejection port substrate having ejection ports for ejecting said ink droplets; and control means that controls ejection of said ink droplets from said ejection ports, wherein each of said ejection ports has an outer opening formed on a side facing said recording medium and an inner opening formed on a side opposite to said side facing said recording medium, at least said inner opening has a shape anisotropy, and a first opening area of said outer opening is larger than a second opening area of said inner opening, and the following relation is satisfied:

$$0.1 \leqq S1/S2 \leqq 0.5,$$

wherein S1 is said second opening area of said inner opening and S2 is said first opening area of said outer opening.

18. An ink jet recording apparatus, comprising:

an ink jet head for ejecting ink droplets onto a recording medium, comprising:

an ejection port substrate having ejection ports for ejecting said ink droplets and being electrically insulative; and control means that controls ejection of said ink droplets from said ejection ports, wherein each of said ejection ports is a through hole having an outer opening formed in a surface of said ejection port substrate on a side facing said recording medium and an inner opening formed in another surface of said ejection port substrate on a side opposite to said side facing said recording medium and connecting said outer opening and said inner opening to each other, at least said inner opening has a shape anisotropy, and a first opening area of said outer opening is larger than a second opening area of said inner opening; and means for supporting said recording medium, wherein said ink jet head is used to record an image corresponding to image data on said recording medium supported by said supporting means.

19. An ink jet recording apparatus, comprising:

an ink jet head for ejecting ink droplets onto a recording medium, comprising:

an ejection port substrate having ejection ports for ejecting said ink droplets; and control means that controls ejection of said ink droplets from said ejection ports, wherein each of said ejection ports has an outer opening formed on a side facing said recording medium and an inner opening formed on a side opposite to said side facing said recording medium, at least said inner opening has a shape anisotropy, and a first opening area of said outer opening is larger than a second opening area of said inner opening; and means for supporting said recording medium, wherein said ink jet head is used to record an image corresponding to image data on said recording medium supported by said supporting means, and the following relation is satisfied:

$$0.1 \leqq S1/S2 \leqq 0.5,$$

wherein S1 is said second opening area of said inner opening and S2 is said first opening area of said outer opening.

* * * * *